US007376362B2

(12) United States Patent
Kajikawa

(10) Patent No.: US 7,376,362 B2
(45) Date of Patent: May 20, 2008

(54) IMAGE FORMING APPARATUS TO DETECT A NEW PROCESS CARTRIDGE

(75) Inventor: Yoshifumi Kajikawa, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 317 days.

(21) Appl. No.: 11/201,687

(22) Filed: Aug. 10, 2005

(65) Prior Publication Data

US 2006/0034625 A1 Feb. 16, 2006

(30) Foreign Application Priority Data

Aug. 10, 2004 (JP) ..... 2004-233438

(51) Int. Cl.
*G03G 15/00* (2006.01)

(52) U.S. Cl. ..... 399/12; 399/13

(58) Field of Classification Search ..... 399/9, 399/12, 13, 24, 25, 27, 29, 111
See application file for complete search history.

(56) References Cited

U.S. PATENT DOCUMENTS 6,330,402 B1 * 12/2001 Sakurai et al. ..... 399/12
6,684,039 B1 * 1/2004 Wazana et al. ..... 399/109
7,024,131 B2 * 4/2006 Komatsu et al. ..... 399/109
7,177,552 B2 * 2/2007 Koike ..... 399/12
2005/0031359 A1 2/2005 Ishii

FOREIGN PATENT DOCUMENTS

JP 2001-80163 A 3/2001

* cited by examiner

*Primary Examiner*—Hoan Tran
(74) *Attorney, Agent, or Firm*—Darby & Darby P.C.

(57) ABSTRACT

An image forming apparatus used with a replaceable process cartridge mounted therein, including: a new article detecting unit which detects whether or not the mounted process cartridge is a new process cartridge; a detection storage unit which stores a number of times of detection that the new article detecting unit has detected that the mounted process cartridge is a new process cartridge; and a type determining unit which determines a type of the mounted process cartridge, based on the number of times of detection stored in the detection storage unit, when the new article detecting unit has detected that the mounted process cartridge is a new process cartridge.

15 Claims, 12 Drawing Sheets

IMAGE FORMING APPARATUS TO DETECT A NEW PROCESS CARTRIDGE

INCORPORATION BY REFERENCE

The present application claims priority under 35 U.S.C. §119 to Japanese Patent Application No. 2004-233438 filed on Aug. 10, 2004. The content of the application is incorporated herein by reference in its entirety.

BACKGROUND OF THE INVENTION

1. Field of the Invention

The present invention relates to an image forming apparatus used with a replaceable process cartridge mounted therein.

2. Description of the Related Art

Conventionally, in an image forming apparatus used with a process cartridge mounted therein, when the residual amount of toner filled in the process cartridge decreases, a notification is sent to a user to replace the process cartridge with a new process cartridge.

At this time, in order to correctly detect that the residual amount of toner decreases, for instance, the amount of consumed toner is accumulated whenever images are formed, then the toner consumption amount is compared with the capacity of the toner (reference value for determining 'toner empty') which has been stored in an image forming apparatus in advance, and then the residual amount is considered as decreased (toner empty state) when the consumption amount approaches the amount of the toner stored in the image forming apparatus (refer to JP-A-2001-80163 (for instance, after section [0020]).

SUMMARY OF THE INVENTION

However, in the above-described construction, only by comparing the amount of toner consumed in forming an image with a constant value indicating the amount of toner, the amount of toner has decreased is determined. In this construction, the decrease in the residual amount of toner is detected with no relation to an actual amount of toner.

For this reason, if the amount of toner filled in the process cartridge mounted in the image forming apparatus is not constant, it is difficult to correctly detect that the amount of toner has decreased.

In the meantime, as the process cartridge mounted in an image forming apparatus, there are process cartridges having different capacities of toner, for example, a process cartridge, which is mounted in an image forming apparatus when shipping, and a process cartridge which is mounted in an image forming apparatus after the former process cartridge is replaced (that is, a marketed commodity; a process cartridge sold for replacement). More specifically, a process cartridge to be sold as accessories for an image forming apparatus (e.g., a process cartridge which is shipped while being wrapped with an image forming apparatus) has less capacity of toner than a process cartridge which is sold for replacement independently of an image forming apparatus.

In this way, when different types of process cartridges are mounted, in the above-described construction, it is impossible to discriminate the type of a process cartridge. Thus, if the actual capacity of toner is more than the capacity of toner stored in an image forming apparatus, it may be determined that the amount of toner has decreased although the residual amount of toner is sufficient. Further, if the actual capacity of toner is less than the capacity of toner stored in an image forming apparatus, it possibly happens that a decrease in the amount of toner cannot be detected although the residual amount of toner has decreased.

The present invention provides a technique for determining the type of a process cartridge mounted in an image forming apparatus.

According to one aspect of the invention, there is provided an image forming apparatus used with a replaceable process cartridge mounted therein, including: a new article detecting unit which detects whether or not the mounted process cartridge is a new process cartridge, a detection storage unit which stores a number of times of detection that the new article detecting unit has detected that the mounted process cartridge is a new process cartridge, and a type determining unit which determines the type of the mounted process cartridge, based on the number of times of detection stored in the detection storage unit, when the new article detecting unit has detected that the mounted process cartridge is a new process cartridge.

According to the image forming apparatus constructed as above, it is possible to determine the type of a process cartridge after replacement, based on the number of times that new process cartridges are mounted (detected).

In this construction, the detection storage unit stores the number of times of detection (that is, causes the number of time of detection to be stored in a memory) that new process cartridges have been mounted in the image forming apparatus. Here, for example, the detection storage unit may store a number of times of detection obtained by accumulating the detection that the new article detecting unit has detected that the mounted process cartridge is a new process cartridge. In this case, the number of times of detection that new process cartridges have been detected can be obtained by accumulating the detection. In addition, the detection storage unit may obtain a value (for example, a value obtained by repeatedly subtracting one from a predetermined number) that can specify the number of times of detection, besides by means of accumulation, and then store the number of times of detection (or, the value itself) specified from the value.

According to another aspect of the invention, there is provided an image forming apparatus used with the replaceable process cartridge mounted therein, including a new article detecting unit which detects whether or not the mounted process cartridge is a new process cartridge, a forming storage unit which stores a number of times of image forming which is performed by the image forming apparatus, and a type determining unit which determines the type of the mounted process cartridge based on the number of image forming times stored by the forming storage unit when the new article detecting unit has detected that the mounted process cartridge is a new process cartridge.

According to the image forming apparatus constructed as above, it is possible to determine the type of a process cartridge after replacement, based on the number of times (image forming times) that image forming is performed.

The aforementioned forming storage unit stores the number of times (that is, causes the number of times of image forming to be stored in a memory) that image forming is performed. Here, for example, the forming storage unit may store the number of image forming times obtained by accumulating the fact that image forming is performed. In this case, the fact that image forming is performed can be accumulated as the number of image forming times. In addition, the forming storage unit may obtain a value (for example, a value obtained by repeatedly subtracting one from a predetermined number) which can specify the number of times of image forming, besides by means of accumulation, and then store the number of times of image forming (or, the value itself) specified from the value.

According to still another aspect of the invention, there is provided a computer readable medium storing information for causing a computer system of an image forming apparatus, used with a replaceable process cartridge mounted therein, to perform a process including: detecting whether or not the mounted process cartridge is a new process cartridge; storing a number of times of detection in which it is detected that the mounted process cartridge is a new process cartridge; and determining a type of the mounted process cartridge, based on the stored number of times of detection, when it is detected that the mounted process cartridge is a new process cartridge.

The computer system can constitute parts of the above-described image forming apparatus.

In addition, the aforementioned program, which is composed of rows to which order of commands suitable for processing by a computer is numbered, is for making the computer system execute various processing procedures for functioning as all the means included in the above-described image forming apparatus. Further, the program is provided to computer systems or computer system users, for example, through recording media such as an FD, a CD-ROM, a memory card, etc., and communication network such as the internet. These programs may be provided to users in the form of a hard disk of a computer system or in a state preinstalled in a memory. In addition, for example, a computer system mounted in an image forming apparatus, and other computers which can communicate data with an image forming apparatus can be used as the computer system for executing the program.

BRIEF DESCRIPTION OF THE DRAWINGS

The present invention may be more readily described with reference to the accompanying drawings.

DETAILED DESCRIPTION OF THE PREFERRED EMBODIMENTS

First Embodiment

Figure 1:
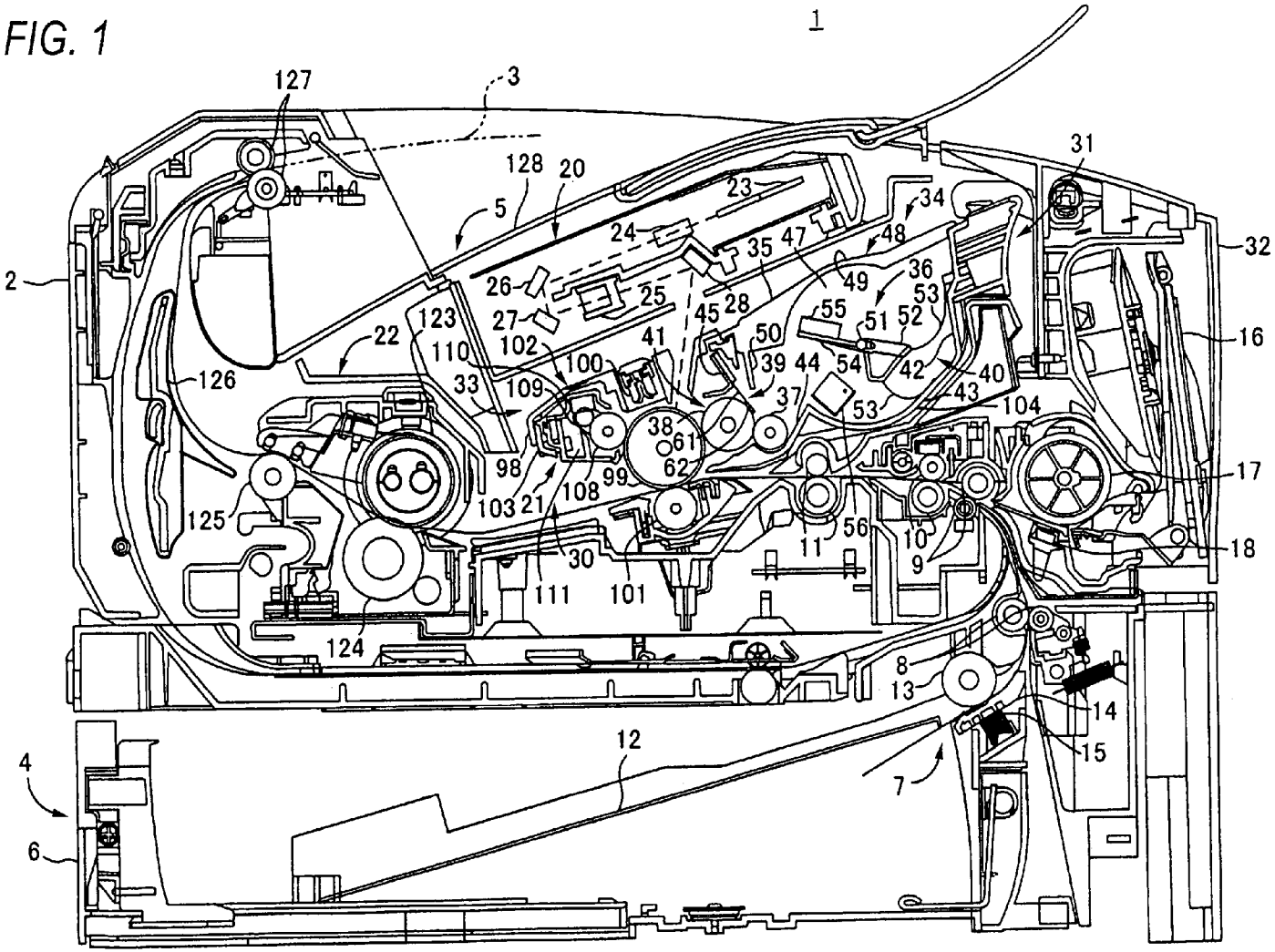
FIG. 1 is a side cross-sectional view showing an essential portion of a laser printer.

FIG. 1 is a side cross-sectional view showing an essential portion of a laser printer serving as an image forming apparatus according to an embodiment of the present invention.

In FIG. 1, the laser printer 1 is an electrophotographic laser printer that forms an image in a non-magnetic mono-component development system. The laser printer 1 is provided in a main frame 2 with a feeder section 4 for feeding sheets 3 and an image forming section 5 for forming images on the fed sheets 3.

The feeder section 4 includes a sheet feed tray 6 removably set on a bottom of the main frame 2, a sheet feed mechanism section 7 disposed at one side (front side) of the sheet feed tray 6 (hereinafter an opposite side to the front side is referred to as the rear side), conveying rollers 8, 9 and 10 disposed downstream of the sheet feed mechanism section 7 in a sheet conveying direction of the sheet 3, and registration rollers 11 disposed downstream of the conveying rollers 8, 9 and 10 in the sheet conveying direction of the sheet 3.

The sheet feed tray 6 is of a box shape with an upper open construction so as to accommodate therein a stack of sheets 3. The sheet feed tray 6 is horizontally detachable to the bottom of the main frame 2. A sheet pressing plate 12 is provided in the sheet feed tray 6 so as to allow the sheets 3 to be stacked on the sheet pressing plate 12. The sheet pressing plate 12 is pivotably supported on one end far from the sheet feed mechanism section 7, so that the other end of the sheet pressing plate 12 near the sheet feed mechanism section 7 is movable in a vertical direction. Disposed on the underside of the sheet pressing plate 12 is a spring (not shown) that urges the sheet pressing plate 12 upwardly. As the amount of sheets 3 stacked on the sheet pressing plate 12 increases, the sheet pressing plate 12 swings downward about the one end far from the sheet feed mechanism section 7, against the urging force of the spring.

The sheet feed mechanism section 7 includes a sheet feed roller 13, a separation pad 14 disposed to face the sheet feed roller 13, and a spring 15 disposed on an underside of the separation pad 14. In the sheet feed mechanism section 7, the separation pad 14 is pressed against the sheet feed roller 13 by an urging force of the spring 15.

An uppermost sheet 3 on the sheet pressing plate 12 is pressed toward the sheet feed roller 13 as the sheet pressing plate 12 is urged upwardly by the spring. By the rotation of the sheet feed roller 13, a leading end of the uppermost sheet 3 is nipped between the sheet feed roller 13 and the separation pad 14. The sheets 3 are separated one by one in cooperation with the sheet feed roller 13 and the separation pad 14. The separated sheet 3 is delivered to registration rollers 11 by conveying rollers 8, 9 and 10.

The registration rollers 11 include a pair of rollers. The registration rollers 11 correct the skew of the sheets 3, and then feed the sheets 3 to an image forming position where a photosensitive drum 99 and a transfer roller 101 (to be described below) contact each other.

The feeder section 4 of the laser printer 1 further includes a multi-purpose tray 16 on which any size of sheets 3 can be stacked, a multi-purpose sheet feed roller 17 that feeds the sheets 3 stacked on the multi-purpose tray 16, and a multi-purpose separation pad 18 disposed so as to face the multi-purpose sheet feed roller 17. The multi-purpose tray 16 is accommodated in a folded manner inside a front cover 32 (described below) when not in use.

The image forming section 5 includes a scanner unit 20, a process unit 21, and a fixing unit 22.

The scanner unit 20 is provided in an upper portion of the main frame 2. The scanner unit 20 includes a laser emitting portion (not shown), a polygon mirror 23 that is driven so as to spin, lenses 24 and 25, and reflecting mirrors 26, 27 and 28.

A laser beam, modulated based on image data, is emitted from the laser emitting portion. The laser beam emitted from the laser emitting portion passes through or reflects off the polygon mirror 23, the lens 24, the reflecting mirrors 26 and 27, the lens 25, and the reflecting mirror 28 in order, as indicated by broken lines in FIG. 1, to irradiate a surface of the photosensitive drum 99 (to be described in detail below) of the process unit 21 with the laser beam.

The process unit 21 is disposed below the scanner unit 20. The process unit 21 is removably set into the main frame 2.

That is, the main frame 2 includes a main accommodating portion 30 for accommodating the process unit 21, an opening 31 leading to the main accommodating portion 30 for removably setting the process unit 21 in the main frame 2, and the front cover 32 for covering or uncovering the opening 31.

The main accommodating portion 30 is provided below the scanner unit 20, as a space that accommodates the process unit 21 therein. The opening 31 is formed as a path leading from the main accommodating portion 30 to the front cover 32. The front cover 32 is provided so as to extend from a front face of the main frame 2 to an upper face of the main frame 2. The front cover 32 can swing between an open position where the front cover 32 uncovers the opening 31 and a closed position where the front cover 32 covers the opening 31.

Further, with the front cover 32 in the open position, the process unit 21 is removably set into the main accommodating portion 30, through the opening 31.

Figure 2:
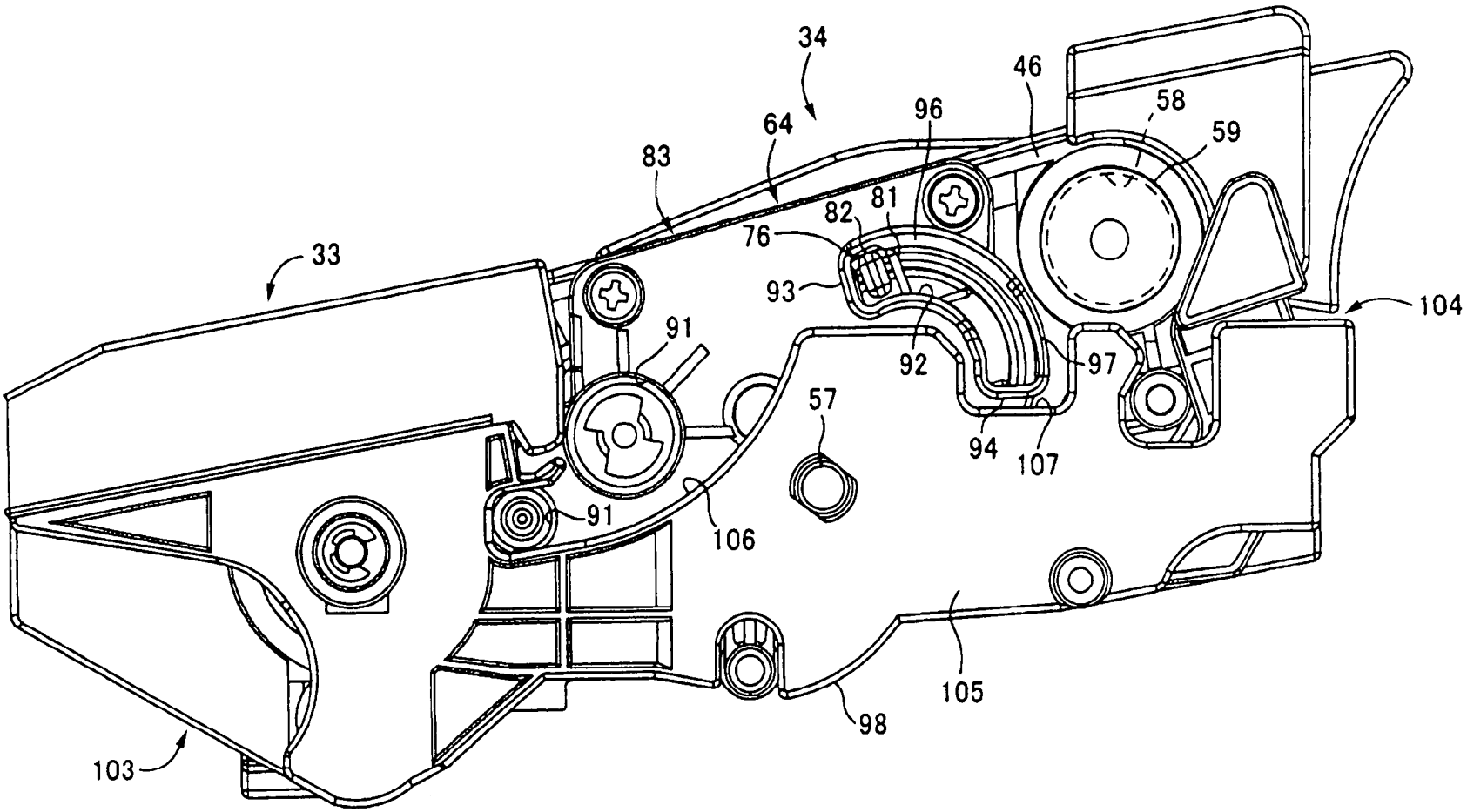
FIG. 2 is a side view of a process unit.

As shown in FIG. 2, the process unit 21 includes a drum cartridge 33 detachably mounted on the main frame 2 and a process cartridge 34 detachably set in the drum cartridge 33.

As shown in FIG. 1, the process cartridge 34 includes a housing 35, an agitator 36, a supply roller 37, a developing roller 38, and a layer thickness regulating blade 39 that are disposed in the housing 35.

The housing 35 is provided with a front wall 42, a bottom wall 43 curved rearward from the lower end of the front wall 42, an underside wall 44 extending rearward from the rear end of the bottom wall 43, and a blade supporting wall 45 formed above the underside wall 44.

The front wall 42, the bottom wall 43, the underside wall 44, and the blade supporting wall 45 are integrally formed with side walls 46 and 47 provided on each side in a width direction of the front, bottom, underside, and blade supporting walls 42, 43, 44 and 45 (that is, a width direction of the housing 35 perpendicular to the frontward and rearward direction). A rear portion of the housing 35 defined by the underside wall 44, the blade supporting wall 45, and the side walls 46 and 47 is open so as to expose a portion of the developing roller 38.

A space defined in a front portion of the housing 35 by the front wall 42, the bottom wall 43, and the side walls 46 and 47 is formed as a toner containing chamber 40. A space defined in a rear portion of the housing 35 by the underside wall 44, the blade supporting wall 45, and the side walls 46 and 47 is formed as a developing chamber 41.

The housing 35 is provided with an upper cover 48 that covers an upward opening portion of the housing 35. The upper cover 48 is formed separately from the housing 35. An upper plate 49 that covers the upward opening portion of the housing 35 is integrally formed with an upper partition 50 that extends downwardly from a rear end portion of the upper plate 49.

The toner containing chamber 40 accommodates, as a developing agent, positively chargeable non-magnetic mono-component toner. The toner is, for example, polymerized toner that is obtained by copolymerizing polymerizable monomers using a known polymerization method, such as a suspension polymerization method. The polymerizable monomers may be styrene-based monomers, such as styrene, and acrylic-based monomers, such as acrylic acid, alkyl (C1-C4) acrylate, and alkyl (C1-C4) methacrylate. Polymerized toner particles are spherical in shape, having excellent fluidity. Toner particle sizes are approximately 6 to 10 micrometers. The toner is mixed with a coloring material, such as carbon black, and wax, as well as an external additive, such as silica, to improve the fluidity of the toner.

An agitator 36 is disposed in the toner containing chamber 40. The agitator 36 is formed of a resin material, such as ABS (Acrylonitrile-Butadiene-Styrene) resin, having flexibility. The agitator 36 includes a shaft 51, a wing member 52 provided on the shaft 51, a flexible film member 53 provided on the wing member 52, and a wiper supporting member 54 provided on the shaft 51. The agitator 36 is provided in the toner containing chamber 40 to rotate only clockwise as shown in FIG. 1.

The shaft 51 is disposed between the side walls 46 and 47 along the width direction of the housing 35 in a substantially central portion of the toner containing chamber 40 in side view. The shaft 51 is a round bar having a diameter of about 3 to 8 millimeters. The shaft 51 has flexibility and is formed to be longer than a distance between the side walls 46 and 47. One end of the shaft 51 near the side wall 46 passes through the side wall 46, protruding outwardly from the toner containing chamber 40, and is rotatably supported by the side wall 46. The other end of the shaft 51 near the side wall 47 is rotatably supported by the side wall 47 in the toner containing chamber 40.

The wing member 52 is disposed across the agitator 36 in the axial direction thereof in the toner containing chamber 40, without contacting the side walls 46 and 47.

The film member 53 is formed of a resin film, such as polyethylene telephthalate. The film member 53 is attached along the lengthwise direction of the wing member 52. To agitate the toner, the film member 53 is set to such a length that the film member 53 is flexed when making contact with the bottom wall 43.

The wiper supporting member 54 is provided at each end of the shaft 51 in the axial direction thereof, to extend in an opposite direction to the direction in which the wing member 52 extends. A wiper member 55 which wipes off a residual toner amount detecting window 56 is screwed on each wiper supporting member 54. Each wiper member 55 is disposed to elastically contact the side walls 46 and 47 to wipe off the residual toner amount detecting window 56.

A residual toner amount detecting window 56 is provided on each side walls 46 and 47 of the toner containing chamber 40.

Figure 3A:
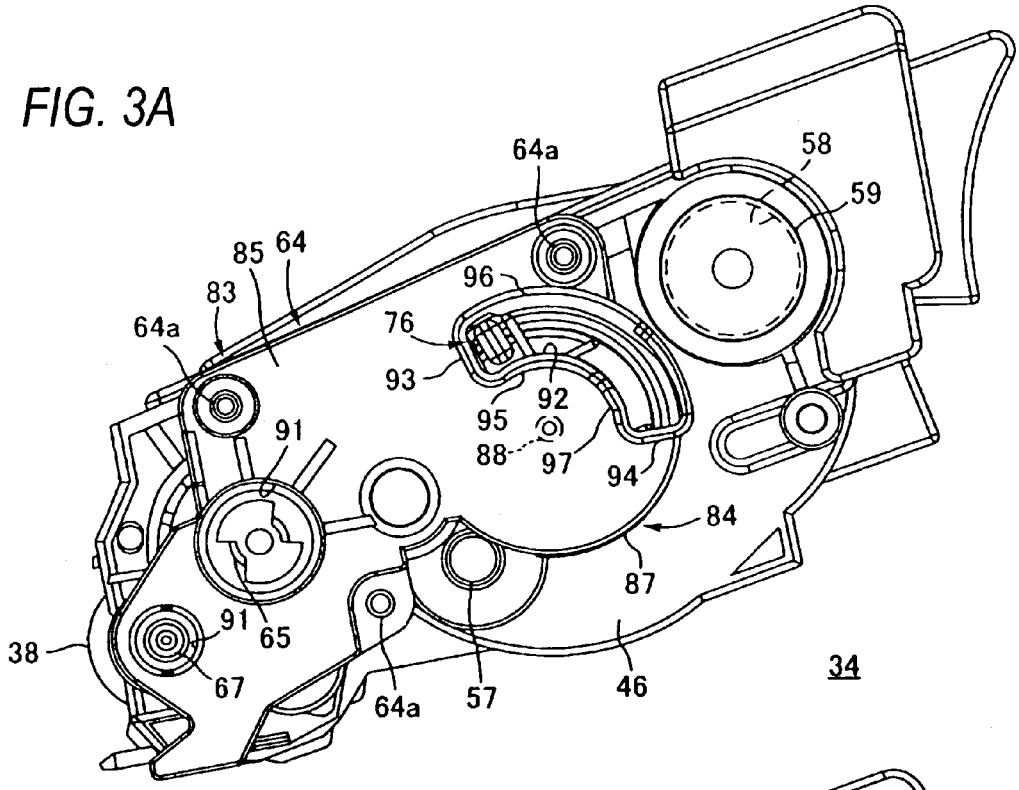
FIG. 3A is a side view showing a process cartridge and FIG. 3B shows a state in which a cover member thereof is removed.
Figure 3B:
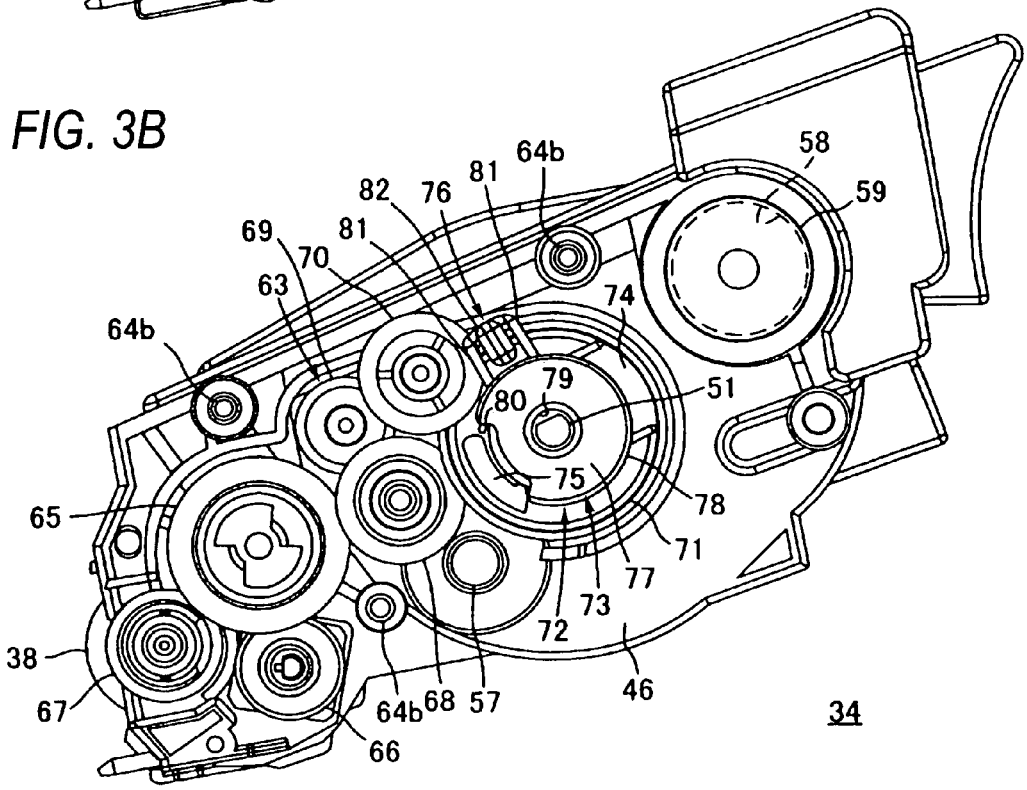

The residual toner amount detecting windows 56 are provided on the side walls 46 and 47 so as to face each other, at a lower rear side of the toner containing chamber 40. As shown in FIG. 3A, a cylindrical light transmission portion 57 is provided on an outer surface of the side walls 46 and 47 in the residual toner amount detecting window 56.

A toner filling port 58 is provided on the side wall 46 of the toner containing chamber 40.

The toner filling port 58 is formed into a substantially round shape. The toner filling port 58 passes through the side wall 46 in the thickness direction thereof. The toner filling port 58 is covered with a cap 59 with the toner filled into the toner containing chamber 40.

The supply roller 37, the developing roller 38, and the layer thickness regulating blade 39 are disposed in the developing chamber 41, as shown in FIG. 1.

The supply roller 37 is disposed on a rear portion of the toner containing chamber 40, along the width direction of the housing 35. The supply roller 37 is rotatably supported on the side walls 46 and 47. The supply roller 37 is rotatable in a direction opposite to a rotating direction of the agitator 36. The supply roller 37 includes a metal roller shaft covered by a roller portion formed of conductive urethane sponge.

The developing roller 38 is disposed behind the supply roller 37, along the width direction of the housing 35. The developing roller 38 is also rotatably supported on the side walls 46 and 47 to expose a portion of the developing roller 38 from an opening formed on a rear portion of the housing 35. The developing roller 38 is rotatable in the same direction as the supply roller 37.

The developing roller 38 includes a metal roller shaft covered by a roller portion formed of a conductive elastic material. More specifically, the roller portion of the developing roller 38 is formed of conductive urethane rubber or silicone rubber including fine carbon particles. A surface of the roller portion of the developing roller 38 is coated with urethane rubber or silicone rubber including fluorine. A power supply (not shown) is connected to the roller shaft of the developing roller 38, to apply a development bias during development.

The supply roller 37 and the developing roller 38 are disposed so as to face each other. The supply roller 37 and the developing roller 38 contact each other such that the supply roller 37 applies some pressure to the developing roller 38. At a contact portion where the supply roller 37 and the developing roller 38 contact each other, the supply roller 37 and the developing roller 38 rotate or move in the opposite directions from each other.

The layer thickness regulating blade 39 is disposed above the supply roller 37 between positions where the developing roller 38 faces the supply roller 37 and the photosensitive drum 28 in the rotating direction of the developing roller 38. The regulating blade 39 is supported by the blade supporting wall 45 of the housing 35.

The regulating blade 39 is disposed along an axial direction of the developing roller 38 to face the developing roller 38. The regulating blade 39 includes a plate spring member 61, and a pressing portion 62 attached to one end of the plate spring member 61 so as to contact the developing roller 38. The pressing portion 62 is formed of insulating silicone rubber. With the plate spring member 61 supported by the blade supporting wall 45, the pressing portion 62 presses the surface of the developing roller 38 with the elasticity of the plate spring member 61.

Figure 4:
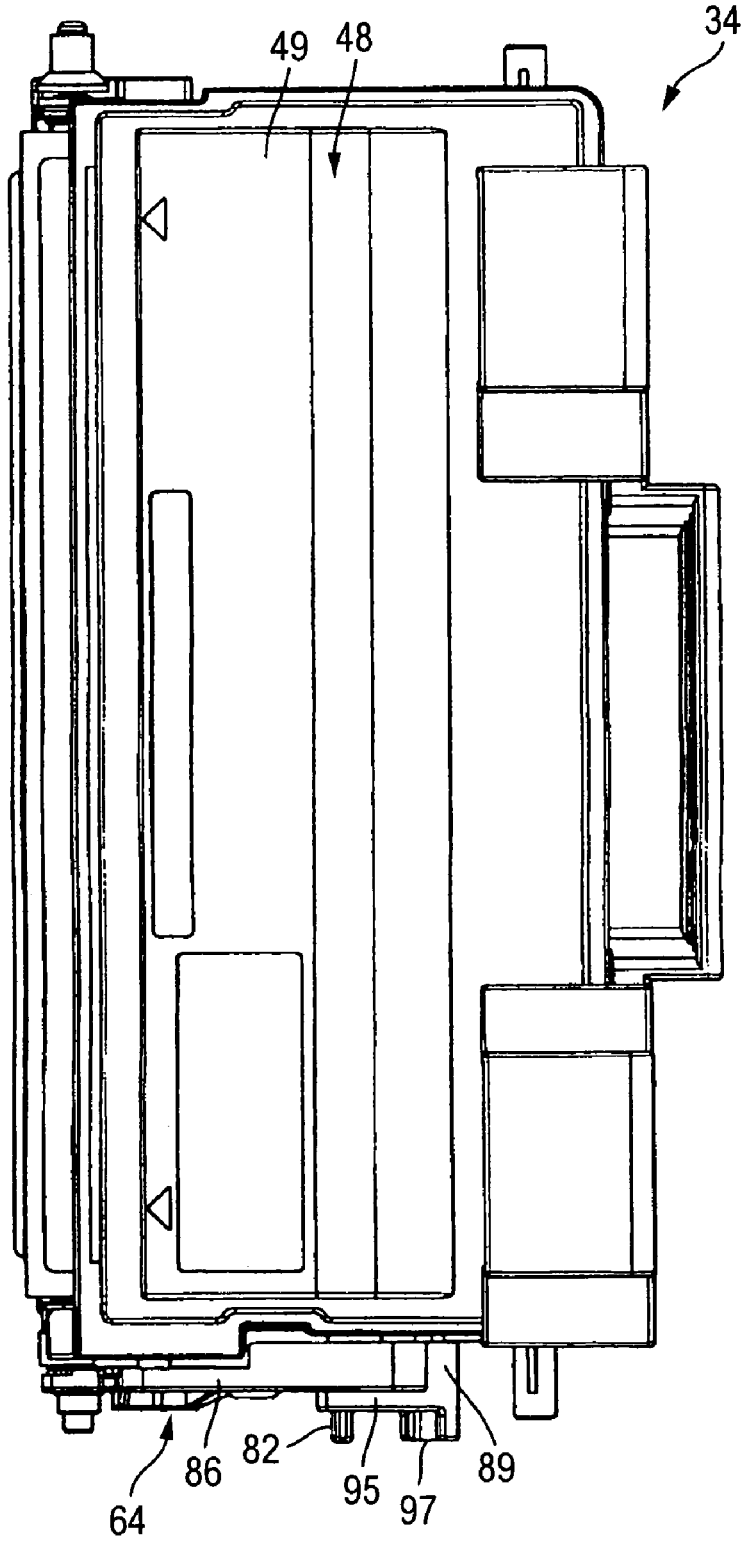
FIG. 4 is a plan view of the process cartridge.

The process cartridge 34 is provided with a gear mechanism portion 63, as shown in FIG. 4, that drives the agitator 36, the supply roller 37, and the developing roller 38 to rotate, and a cover member 64, as shown in FIG. 3A, that covers the gear mechanism portion 63.

The gear mechanism portion 63 is disposed on an outer face of the side wall 46 of the process cartridge 34, as shown in FIG. 4. The gear mechanism portion 63 includes an input gear 65, a supply roller drive gear 66, a developing roller drive gear 67, a first intermediate gear 68, a second intermediate gear 69, a third intermediate gear 70, as a drive gear, an agitator drive gear 71 and a detection gear 72.

The input gear 65 is rotatably provided on an outer face of the side wall 46 between the developing roller 38 and the agitator 36. Drive force from a main motor 224 (see FIG. 7) is input to the input gear 65.

The supply roller drive gear 66 is mounted on an end of the roller shaft of the supply roller 37. The supply roller drive gear 66 is provided below the input gear 65, to engage with the input gear 65.

The developing roller drive gear 67 is mounted on an end of the roller shaft of the developing roller 38. The developing roller drive gear 67 is provided on a rear side of the input gear 65, to engage with the input gear 65.

The first intermediate gear 68 is a two-stage gear rotatably provided on the outer face of the side wall 46 at a front side of the input gear 65. An external gear of the first intermediate gear 68 engages with the input gear 65. An internal gear (not shown) of the first intermediate gear 68 engages with an internal gear of the second intermediate gear 69 (to be described below). The external and internal gears of the first intermediate gear 68 are concentrically and integrally formed.

The second intermediate gear 69 is a two-stage gear rotatably provided on the outer face of the side wall 46 above the first intermediate gear 68. An external gear of the second intermediate gear 69 engages with an external gear of the third intermediate gear 70 (to be described below). An internal gear (not shown) of the second intermediate gear 69 engages with the internal gear of the first intermediate gear 68. The external and internal gears of the second intermediate gear 69 are concentrically and integrally formed.

The third intermediate gear 70 is a two-stage gear rotatably provided on the outer face of the side wall 46 at a front side of the second intermediate gear 69. An external gear of the third intermediate gear 70 engages with the external gear of the second intermediate gear 69 and the detection gear 72. An internal gear (not shown) of the third intermediate gear 70 engages with the agitator drive gear 71. The external and internal gears of the third intermediate gear 70 are concentrically and integrally formed.

The agitator drive gear 71 is disposed on a lower front side of the third intermediate gear 70, to engage with the internal gear of the third intermediate gear 70. The agitator drive gear 71 is mounted on an end of the shaft 51 of the agitator 36 passing through the side wall 46 and protruding outwardly.

The detection gear 72 is concentric with the agitator drive gear 71 and is mounted on an end of the shaft 51 of the agitator 36 outwardly of the agitator drive gear 71 in an axial direction of the shaft 51 to overlap with the agitator drive gear 71. The detection gear 72 integrally rotates along with the rotation of the shaft 51 of the agitator 36.

The detection gear 72 is integrally formed with a detection gear main body 73, a guide member 74, a partly tooth missing gear 75, and a contact member 76, as a determination member.

The detection gear main body 73 is integrally formed with a side plate 77 of a substantially round shape in side view, and a cylindrical portion 78 of a substantially cylindrical shape that is bent toward the agitator drive gear 71 from an edge of the side plate 77.

A round hole 79 which passes through the side plate 77 in a thickness direction thereof is formed at a substantially central portion of the side plate 77. An end of the shaft 51 of the agitator 36 is inserted in the hole 79. The side plate 77 is secured at the end of the shaft 51 of the agitator 36, through the hole 79. Accordingly, as the shaft 51 of the agitator 36 rotates, the detection gear 72 integrally rotates therewith. A supporting shaft 88 (to be described below) of the cover member 64 is fitted into the hole 79.

The cylindrical portion 78 is formed with a cut-out portion 80 where the cylindrical portion 78 is partly cut out in a circumferential direction thereof.

The guide member 74 is formed in the cylindrical portion 78 opposite to the cut-out portion 80 with respect to the hole 79. The guide member 74 is of a substantially arc shape in side view, with approximately the same width as the cut-out portion 80. The guide member 74 protrudes from the cylindrical portion 78 in substantially a radial direction of the side plate 77.

The partly tooth missing gear 75, whose one end is connected to an end of the cut-out portion 80 of the cylindrical portion 78. The partly tooth missing portion 75 is of a substantially arc shape extending in a circumferential direction of the cylindrical portion 78 from the end. The partly tooth missing gear 75 has a length to engage with the third intermediate gear 70 when only the detection gear 72 is in a drive force transmitting position, which will be described below. The other end of the partly tooth missing gear 75 is a free end that is not connected to the other end of the cut-out portion 80.

The contact member 76 is disposed between the guide member 74 and the partly tooth missing gear 75 in the circumferential direction of the cylindrical portion 78. The contact member 76 includes a supporting portion 81 and a contact portion 82 supported by the supporting portion 81.

The supporting portion 81 is formed to extend outwardly from the cylindrical portion 78.

The contact portion 82 is of a substantially rectangular shape in plan view (see FIG. 4). The contact portion 82 is formed such that one end thereof is connected to the free end of the supporting portion 81 and the other end thereof extends outwardly in the axial direction of the shaft 51 of the agitator 36.

The detection gear 72 is mounted on an end of the shaft 51 of the agitator 36 extending from the side wall 46 of the process cartridge 34, first to place the detection gear 72 in a unused position where the partly tooth missing gear 75 of the detection gear 72 is not engaged with the third intermediate gear 70, and the partly tooth missing gear 75 is disposed upstream of the third intermediate gear 70 in a rotating direction of the shaft 51.

As shown in FIG. 3A, the cover member 64 is disposed to cover the gear mechanism portion 63, on an outer face of the side wall 46 of the process cartridge 34. The cover member 64 includes a rear cover portion 83 that covers the input gear 65, the supply roller drive gear 66, the developing roller drive gear 67, the first intermediate gear 68, the second intermediate gear 69, and the third intermediate gear 70, and a front cover portion 84 that covers the agitator drive gear 71 and the detection gear 72. The rear cover portion 83 and the front cover portion 84 are integrally formed.

The rear cover portion 83 includes a rear plate portion 85 disposed outward of the input gear 65, the supply roller drive gear 66, the developing roller drive gear 67, the first intermediate gear 68, the second intermediate gear 69, and the third intermediate gear 70, and a rear leg portion 86 (as shown in FIG. 4) that is bent from an edge of the rear plate portion 85 toward the side wall 46 of the process cartridge 34. The rear plate portion 85 and the rear leg portion 86 are integrally formed. The rear cover portion 83 is formed with shaft holes 91 that expose the respective shafts of the input gear 65 and the developing roller drive gear 67.

The front cover portion 84 includes a disc portion 87 that is formed in a substantially disc shape and that is disposed outward of the agitator drive gear 71 and the detection gear 72, and a front leg portion 89 (as shown in FIG. 4) that is bent from an edge of the disc portion 87 toward the side wall 46 of the process cartridge 34. The disc portion 87 and the front leg portion 89 are integrally formed. Formed on the disc portion 87 is a slot 92 of a substantially arc shape having one end 93 disposed on the upper rear side and the other end 94 disposed on the lower front side.

More specifically, the slot 92 exposes the contact portion 82 in the disc portion 87. The slot 92 is formed into a substantially arc shape in plane view along which the contact portion 82 moves. The one end 93 of the slot 92 is associated with a position of the contact portion 82 when the partly tooth missing gear 75 is positioned in the unused position. The other end 94 of the slot 92 is associated with a position of the contact portion 82 when the partly tooth missing gear 75 is positioned in a used position, which will be described below. The slot 92 is provided with a guide wall 95 formed along the slot 92, an extended portion 97 connected to the guide wall 95, and a resistance application portion 96.

The guide wall 95 is provided on the disc portion 87 to surround the slot 92 and to guide the contact portion 82 along its movement path. The guide wall 95 extends outwardly in the same direction as the contact portion 82 protrudes from the disc portion 87, to expose the contact portion 82 from the guide wall 95 by a predetermined length, as shown in FIG. 4. The extended portion 97 is provided on the guide wall 95 on the side of the other end 94 of the slot 92.

The extended portion 97 is formed on the guide wall 95 on the other side of the other end 94 of the slot 92, into a substantially U-shape in side view. The length of the extended portion 97 is substantially equal to the length of the contact portion 82 in which a predetermined length is exposed outwardly from the disc portion 87, as shown in FIG. 4.

As shown in FIG. 3A, a resistance application portion 96 is formed from a portion near the one end 93 to a portion near the other end 94, to protrude slightly inwardly toward the slot 92 from an upper edge of the slot 92. The resistance application portion 96 regulates the width of the slot 92, to apply resistance to the contact portion 82 while the contact portion 82 is moving along the slot 92.

The disc portion 87 is provided with the supporting shaft 88 that supports the detection gear 72 at a substantially central portion of an inner side of the disc portion 87 that faces the side wall 46 of the process cartridge 34. The supporting shaft 88 is fitted into the hole 79 of the detection gear 72 and rotatably supports the detection gear 72.

The front leg portion 89 extends from an edge of the disc portion 87 toward the side wall 46 of the process cartridge 34, to cover the agitator drive gear 71 and the detection gear 72, as shown in FIG. 4. The front leg portion 89 is provided so as to guide the guide member 74 of the detection gear 72 when the detection gear 72 rotates together with the shaft 51 of the agitator 36, as well as to protect the teeth portion 75*a* of the detection gear 72.

Screw holes 64*a* are formed in the cover member 64 at an upper rear portion, an upper front portion, and a lower central portion. In association with the screw holes 64*a* formed on the cover member 64, screw holes 64*b* are formed in the side wall 46 of the process cartridge 34.

The shafts of the input gear 65 and the developing roller drive gear 67 are fitted into the relevant shaft holes 91 formed in the cover member 64. The supporting shaft 88 of the cover member 64 is fitted into the hole 79 formed in the side plate 77 of the detection gear main body 73. With the contact portion 82 of the detection gear 72 exposed from the slot 92 of the cover member 64, the cover member 64 is screwed on the side wall 46 of the developing cartridge using the screw holes 64*a*, 64*b* so as to be mounted on the side wall 46 of the process cartridge 34.

With the cover member 64 secured on the side wall 46, the contact portion 82 is exposed from the slot 92 at the one end 93.

As shown in FIG. 1, the drum cartridge 33 includes a drum frame 98, a photosensitive drum 99 disposed in the drum frame 98, a charger 100, a transfer roller 101, and a cleaning unit 102.

As shown in FIG. 2, a rear portion of the drum frame 98 is formed as a drum accommodating portion 103 that accommodates the photosensitive drum 99, the charger 100, the transfer roller 101, and the cleaning unit 102. A front portion of the drum frame 98 is open upwardly and formed as a process accommodating portion 104 that removably accommodates the process cartridge 34. Formed on a side wall 105 of the drum frame 98 are an introducing portion 106, that introduces each shaft of the input gear 65 and the developing roller drive gear 67, and a receiving portion 107 formed to the front side of the introducing portion 106.

The introducing portion 106 is formed as a cut-off portion of a substantially sector shape in side view, curving downwardly toward the rear side from an upper edge of the side wall 105 of the drum frame 98.

The receiving portion 107 is formed in the side wall 105 of the drum frame 98, as a recess curving downwardly. The receiving portion 107 is associated with the slot 92 of the process cartridge 34 when the process cartridge 34 is set relative to the drum cartage 33. The receiving portion 107 has a size large enough to receive the extended portion 97 and the contact portion 82.

The photosensitive drum 99 is disposed behind the developing roller 38 to face the developing roller 38, as shown in FIG. 1. The photosensitive drum 99 is disposed along a width direction of the drum frame 98, and rotatably supported at each end of the drum frame 98 in the width direction of the drum frame 98. The photosensitive drum 99 includes an aluminum cylindrical drum that is electrically grounded, and a positively chargeable photosensitive coating layer that is made from polycarbonate and formed on the surface of the aluminum cylindrical drum.

The charger 100 is disposed along the width direction of the drum frame 98 above the photosensitive drum 99 with a predetermined distance therebetween, to prevent the charger 100 from contacting the photosensitive drum 99. The charger 100 is a positively charging scorotron charger that generates a corona discharge from a tungsten wire. The charger 100 uniformly and positively charges the surface of the photosensitive drum 99.

The transfer roller 101 is disposed along the width direction of the drum frame 98, below the photosensitive drum 99, to face the photosensitive drum 99. The transfer roller 101 is rotatably supported at each end of the drum frame 98 in the width direction of the drum frame 98. The transfer roller 101 includes a metal roller shaft covered by a roller portion formed of conductive rubber. The roller shaft is connected to a power source (not shown). A transfer bias is applied to the roller shaft of the transfer roller 101 to transfer the toner onto the sheet 3.

The cleaning unit 102 is disposed in a rear portion of the drum accommodating portion 103, opposite to the developing roller 38 with respect to the photosensitive drum 99. The cleaning unit 102 includes a first cleaning roller 108, a second cleaning roller 109, a scraping sponge 110, and a paper powder reservoir 111.

The first cleaning roller 108 is disposed along the width direction of the drum frame 98 to face the photosensitive drum 99. The first cleaning roller 108 is rotatably supported at each end of the drum frame 98 in the width direction of the drum frame 98. A cleaning bias is applied to the first cleaning roller 108 during cleaning for removing the toner remaining on the photosensitive drum 99.

The second cleaning roller 109 is disposed along the width direction of the drum frame 98 to face the first cleaning roller 108. The second cleaning roller 109 is rotatably supported at each end of the drum frame 98 in the width direction of the drum frame 98.

The scraping sponge 110 is disposed along the width direction of the drum frame 98 above the second cleaning roller 109 to contact the second cleaning roller 109. The scraping sponge 110 is rotatably supported at each end of the drum frame 98 in the width direction of the drum frame 98.

The paper powder reservoir 111 is formed behind the first cleaning roller 108 as a space in the drum accommodating portion 103.

In the laser printer 1, the process cartridge 34 is set relative to the drum cartridge 33. More specifically, the process cartridge 34 is set from above into the process accommodating portion 104 in the drum frame 98 of the drum cartridge 33. A shaft 38*a* of the developing roller 38 protrudes from the shaft hole 91 of the cover member 64 and is inserted above the introducing portion 106 into the lowest position in the introducing portion 106. The extended portion 97 provided at the other end 94 of the slot 92 in the cover member 64 is received by the receiving portion 107 formed in the drum frame 98. The process unit 21 is constituted by the process cartridge 34 mounted to the drum cartridge 33, as described above.

The process unit 21 is accommodated in the main accommodating portion 30 of the main frame 2, through the opening 31 that is open when the front cover 32 is positioned in the open position.

In the meantime, the main frame 2 is provided with a new/old discriminating portion 112 that determines whether the process cartridge 34 is unused or used when the process unit 21 is accommodated in the main accommodating portion 30.

Figure 5A:
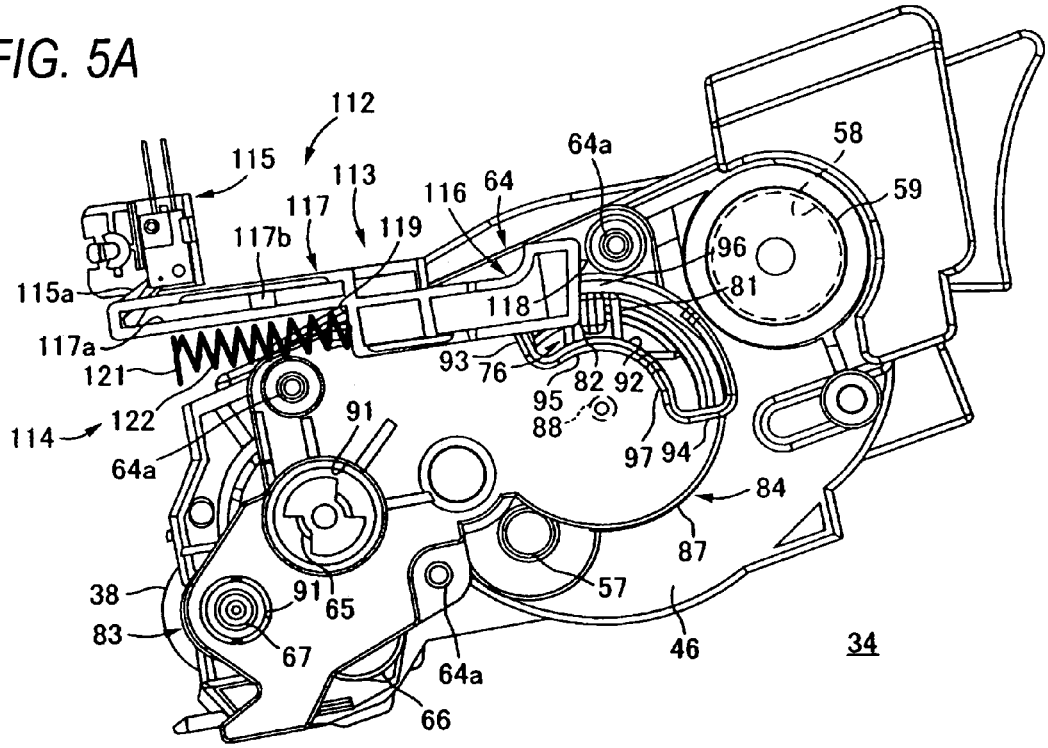
FIG. 5A is a side view showing the process cartridge and FIG. 5B shows a state in which the cover member thereof is removed.

The new/old discriminating portion 112 is provided on a side wall of the main frame 2 in the main accommodating portion 30. As shown in FIG. 5A, the new/old discriminating portion 112 includes an actuator 113, as a contacted member, a spring portion 114, and a new/old detecting sensor 115.

The actuator 113 is formed into a substantially lever shape. The actuator 113 is provided on a front side thereof with a pressing portion 116 and on a rear side of the pressing portion 116 with a guide 117. The pressing portion 116 and the guide 117 are integrally formed.

The pressing portion 116 is of a substantially rectangular shape in side view. A contacted surface 118 is formed on a front edge of the pressing portion 116. A pressed surface 119 is formed on a rear edge of the pressing portion 116.

The guide 117 is of an elongated bar shape. The guide 117 is formed to extend rearward from an upper rear edge of the pressing portion 116. The guide 117 includes a guide groove 117*a* formed to extend along the front and rearward direction.

In the meantime, a guide protrusion 117*b*, that engages in the guide groove 117*a*, is formed on the main frame 2. The actuator 113 is slidably attached to the main frame 2 to move in the front and rearward direction, with the guide protrusion 117*b* engaged in the guide groove 117*a*.

The spring portion 114 includes a fixed plate 121 fixed to the main frame 2 and a spring 122 whose one end is fixed to the fixed plate 121, as an urging member. The other end of the spring 122 contacts the pressed surface 119 of the pressing portion 116. With an urging force of the spring 122, the actuator 113 is located in a first position where the actuator 113 is constantly urged toward the forward direction.

The new/old detecting sensor 115 is disposed above the rear edge of the guide 117. The new/old detecting sensor 115 includes a detection lever 115*a* that is movable in the forward and rearward direction. The detection lever 115*a* is engaged with the guide groove 117*a* of the guide 117. As the actuator 113 moves in the forward or rearward direction, the detection lever 115*a* also moves accordingly in the forward or rearward direction. As the detection lever 115*a* moves in the forward direction, the new/old detecting sensor 115 determines that the process cartridge 34 is used. As the detection lever 115*a* moves in the rearward direction, the new/old detecting sensor 115 determines that the process cartridge 34 is new or unused.

Figure 5B:
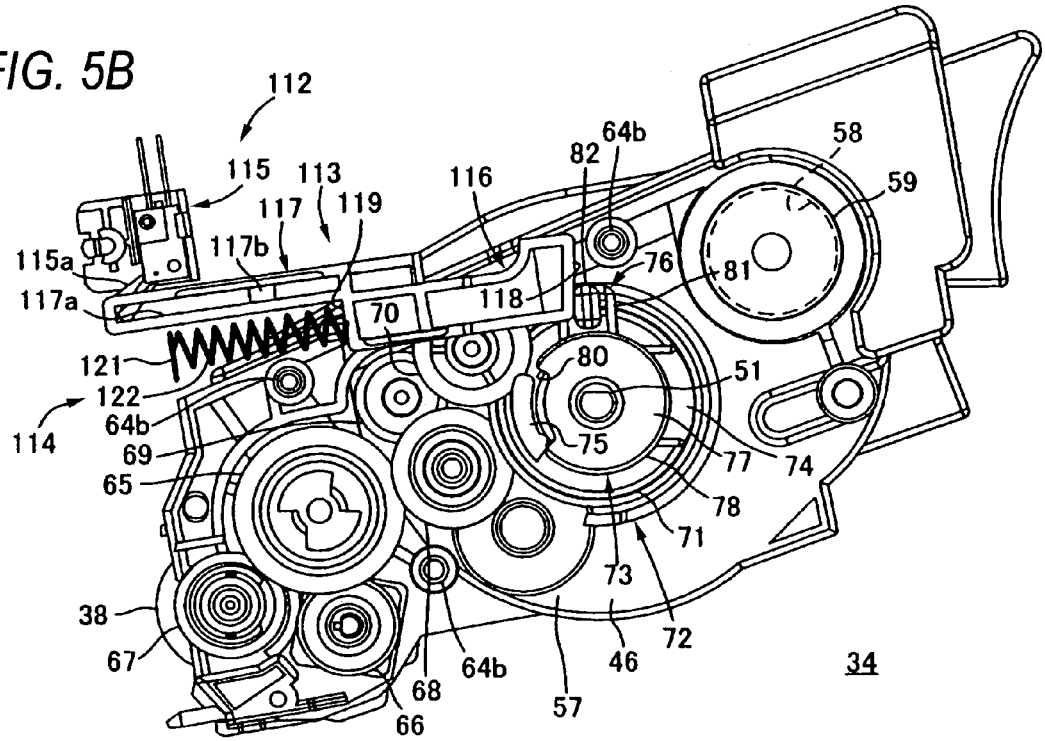

Further, as the process unit 21 is set into the main accommodating portion 30 of the main frame 2, the contact portion 82 of the detection gear 72 makes contact with the contacted surface 118 of the actuator 113. The contact portion 82 of the detection gear 72 is slightly moved from the one end 93 of the slot 92 toward the other end 94 (toward the front side of the main frame 2), which is an opposite direction to a setting direction of the process cartridge 34. As shown in FIG. 5B, the partly tooth missing gear 75 of the detection gear 72 is moved from the unused position where the partly tooth missing gear 75 is not engaged with the third intermediate gear 70, to the drive force transmitting position where the partly tooth missing gear 75 is engaged with the third intermediate gear 70.

At this time, the actuator 113, contacting the contact portion 82, is located in a second position where the actuator 113 is moved in the rearward direction against the urging force of the spring 122, by a reaction force applied when the actuator 113 contacts the contact portion 82. Thereafter, the detection lever 115*a* of the new/old detecting sensor 115 is moved in the rearward direction in accordance with the rearward movement of the actuator 113. Thus, it is determined that the process cartridge 34 is new.

In the laser printer 1, as the process unit 21 is set into the main accommodating portion 30, an idling operation is started, so that the agitator 36 starts rotating.

As the warming-up operation is started, the drive force is transmitted from the input gear 65 to the detection gear 72 engaged with the third intermediate gear 70 in the drive force transmitting position, through the first intermediate gear 68, the second intermediate gear 69, and the third intermediate gear 70, at the same time as the drive force is transmitted from the input gear 65 to the agitator drive gear 71, through the first intermediate gear 68, the second intermediate gear 69, and the third intermediate gear 70. Thus, the detection gear 72 rotates together with the shaft 51. The detection gear 72 located in the drive force transmission position is moved to the used position where the detection gear 72 is not engaged with the third intermediate gear 70, as shown in FIG. 6B.

Figure 6A:
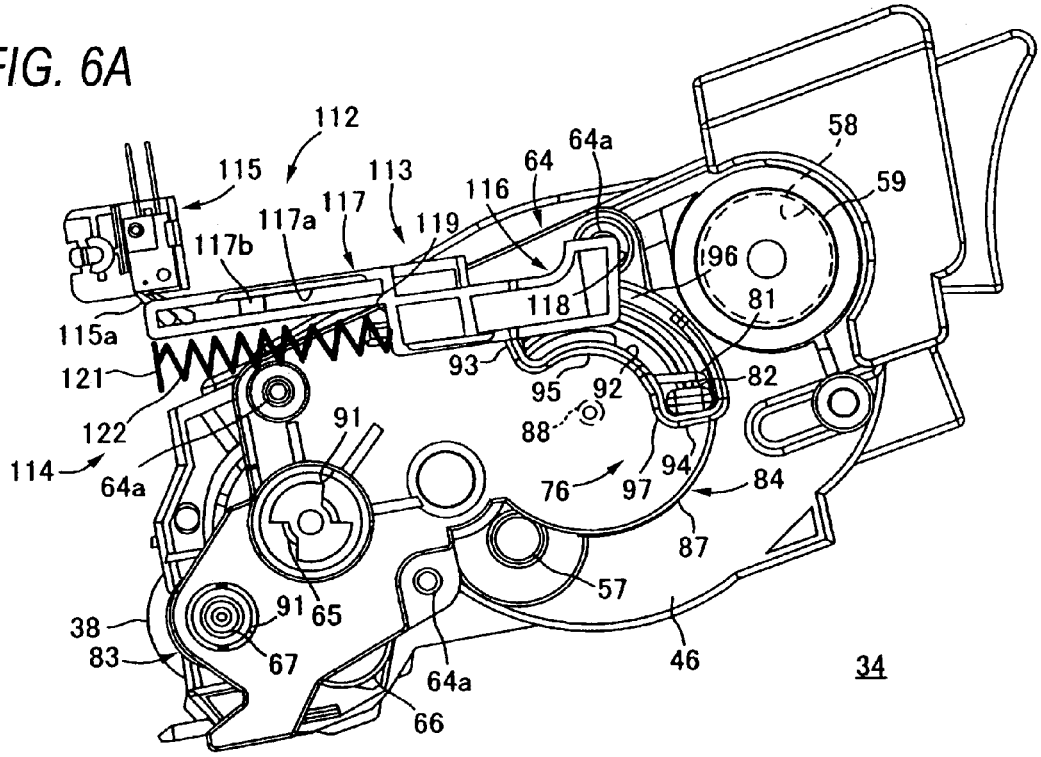
FIG. 6A is a side view showing the process cartridge and FIG. 6B shows a state in which the cover member thereof is removed.
Figure 6B:
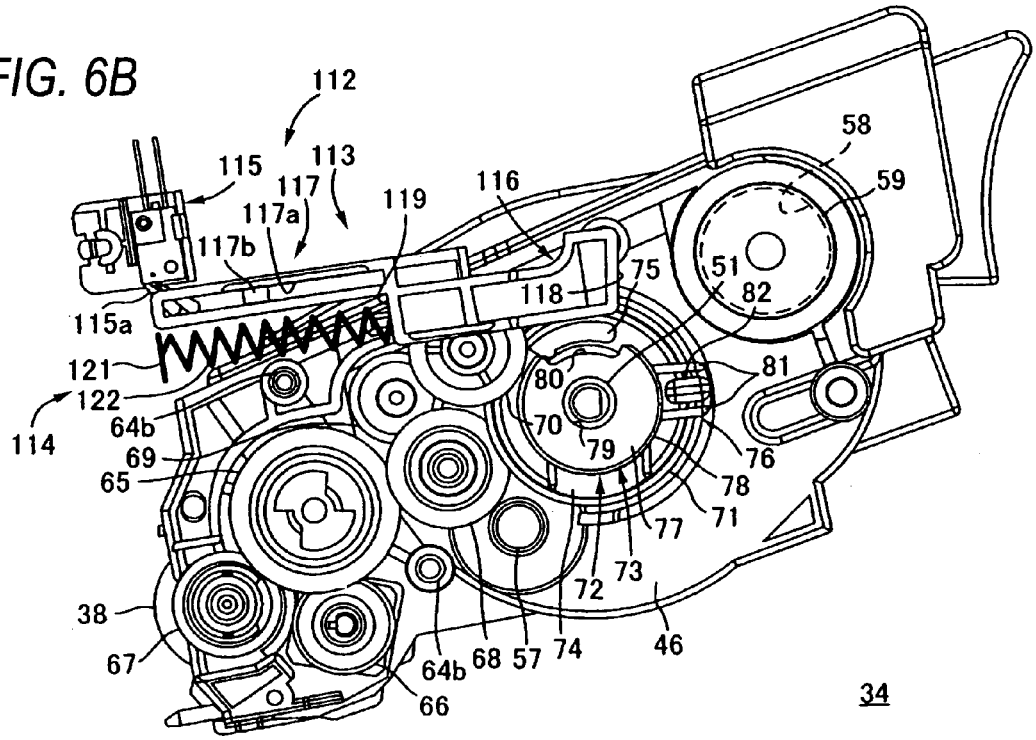

At this time, the contact portion 82 positioned in the slot 92 slightly away from the one end 93, as shown in FIG. 5A, is moved along the slot 92 to the other end 94, as shown in FIG. 6A, while the contact portion 82 is subject to the application of resistance by the resistance application portion 96. The contact portion 82 moved to the other end 94 is surrounded by the extended portion 97 which is formed in the same length as the contact portion 82.

As the contact portion 82 is moved to the other end 94, the actuator 113 is moved forwardly again to the first position as a result of the urging force of the spring 122. The detection lever 115*a* of the new/old detecting sensor 115 is moved forwardly in accordance with the movement of the actuator 113 in the forward direction. Thus, it is determined that the process cartridge 34 is not new.

The agitator 36 only rotates in the clockwise direction. Therefore, the detection gear 72 rotated to the used position does not rotate back to the unused position. In other words, the detection gear 72 is irreversibly rotated to the used position from the unused position. With the detection gear 72 located in the used position, the detection gear 72 slides relative to the shaft 51 to allow the rotation of the shaft 51.

As the warming-up operation is finished, a printing operation is then performed. As shown in FIG. 1, the toner contained in the toner containing chamber 40 is scooped up by the film member 53 according to the rotation of the agitator 36 and conveyed to the developing chamber 41.

The toner conveyed to the developing chamber 41 is supplied to the developing roller 38 by the rotation of the supply roller 37. When the toner is supplied from the supply roller 37 to the developing roller 38, the toner is positively charged by the friction between the supply roller 37 and the developing roller 38.

The charged toner is carried onto the surface of the developing roller 38, and enters between the developing roller 38 and the pressing portion 62 of the regulating blade 39, as the developing roller 38 rotates. At the time when the toner enters between the developing roller 38 and the pressing portion 62, the toner is further frictionally charged and carried on the surface of the developing roller 38 as a thin layer whose thickness has been regulated.

In the meantime, in the drum cartridge 33, the surface of the photosensitive drum 99 is uniformly and positively charged by the charger 100 while the photosensitive drum 99 rotates. As the surface of the photosensitive drum 99 is selectively exposed to the laser beam emitted from the scanner unit 20 based on image data, an electrostatic latent image is formed on the surface of the photosensitive drum 99.

Thereafter, as the toner, which is carried on the developing roller 38 and is positively charged, is brought into confrontation with the photosensitive drum 99 in accordance with the rotation of the developing roller 38, the toner is supplied to parts of the photosensitive drum 99 selectively exposed to the laser beam where the potential level is lower than the remaining portion of the photosensitive drum 99 surface that remains uniformly positively charged. Thus, the toner is selectively carried on the photosensitive drum 99, making the toner image visible.

While the photosensitive drum 99 is rotated, the sheet 3 fed by the register rollers 11 makes contact with the surface of the photosensitive drum 99. The toner carried on the surface of the photosensitive drum 99 is transferred onto the sheet 3 when the sheet 3 passes between the photosensitive drum 99 and the transfer roller 101. The sheet 3 having the toner transferred thereon is fed to the fixing unit 22.

The toner which remains on the photosensitive drum 99, without being transferred onto the sheet 3, is collected by the cleaning unit 102. More specifically, in the cleaning unit 102, a low bias is applied to the first cleaning roller 108 when opposing the portion of the photosensitive drum 99 carrying the toner that was to be transferred onto the sheet 3 but remains on the photosensitive drum 99, to temporarily catch the toner remaining on the photosensitive drum 99.

In the meantime, a high bias is applied to the first cleaning roller 108 when opposing the portion of the photosensitive drum 99 that does not carry toner for transfer onto the sheet 3, that is, when a portion of the photosensitive drum 99 corresponding to an interval between two successive sheets 3 contacts the first cleaning roller 108, in order to return the toner temporarily caught by the first cleaning roller 108 to the photosensitive drum 99. Paper powders attached by the sheet 3 to the photosensitive drum 99 when the toner is transferred onto the sheet 3 are also caught by the first cleaning roller 108. The toner returned to the photosensitive drum 99 is collected by the developing roller 38. The paper powders caught by the first cleaning roller 108 are then caught by the second cleaning roller 109 when the first cleaning roller 108 is brought into confrontation with the second cleaning roller 109. The paper powders caught by the second cleaning roller 109 are scraped by the scraping sponge 110 and stored in the paper powder reservoir 111.

The fixing unit 22 is positioned downstream of the process unit 21 in the sheet feeding direction, behind the process unit 21. The fixing unit 22 includes a heat roller 123, a pressure roller 124 and feed rollers 125. The heat roller 123 includes a metal tube accommodating a halogen lamp as a heat source. The pressure roller 124 is disposed below the heat roller 123 to press the heat roller 123 from below. The feed rollers 125 are disposed downstream of the heat roller 123 and the pressure roller 124 in the sheet feeding direction.

The toner transferred onto the sheet 3 is thermally fixed to the sheet 3 while the sheet 3 passes between the heat roller 123 and the pressure roller 124. The sheet 3 is guided by the feed rollers 125 to a guide plate 126 vertically disposed behind the feed rollers 125. Then, the sheet 3 is fed toward discharge rollers 127.

The sheet 3 fed to the discharge rollers 127 is discharged onto a discharge tray 128.

[Control System]

Hereinafter, a control system of the laser printer 1 will be described.

Figure 7:
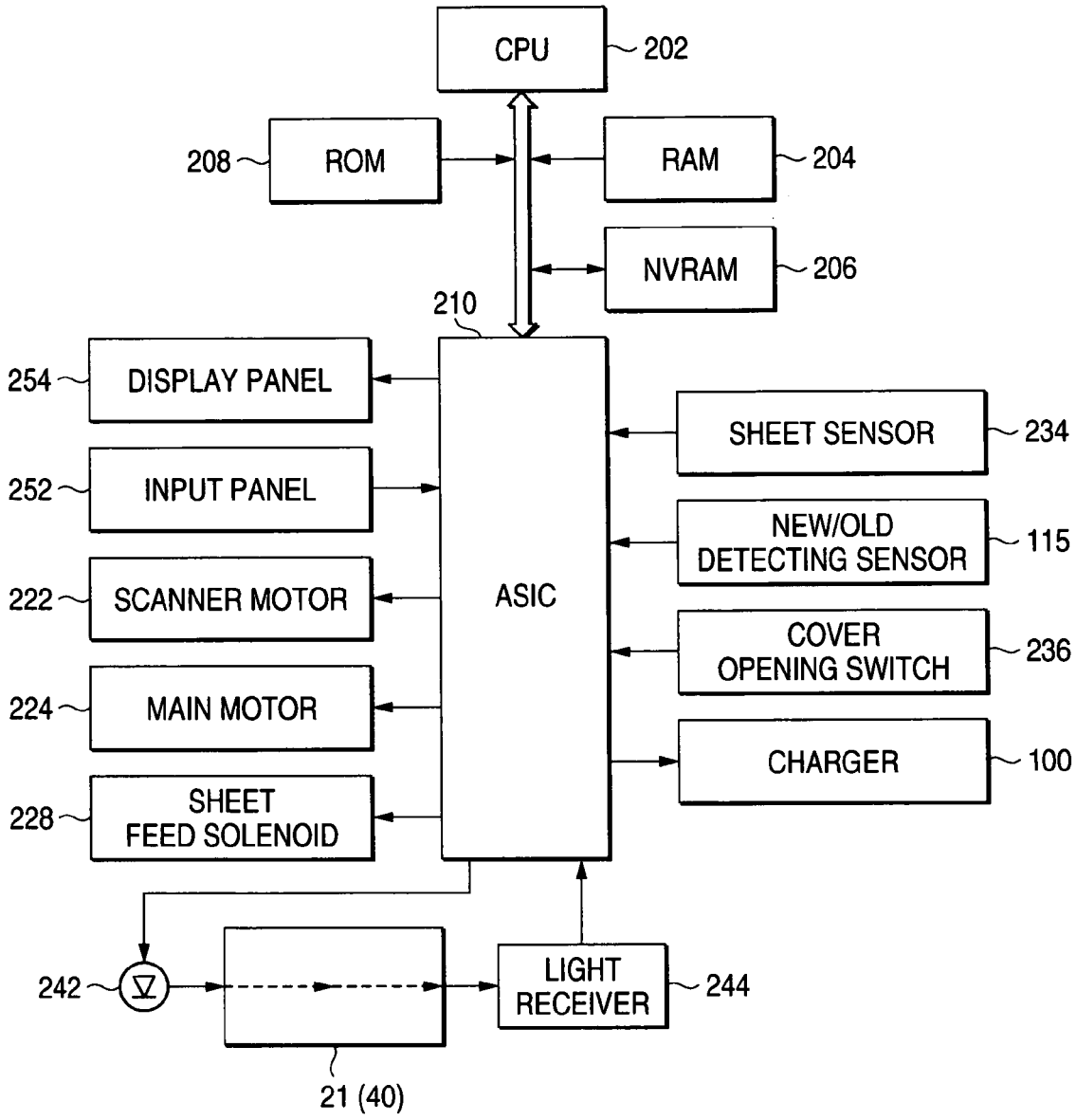
FIG. 7 is a block diagram showing a control system of the laser printer.

As shown in FIG. 7, the control system of the laser printer 1 includes a CPU 202, a RAM 204, a NVRAM (Non-Volatile RAM) 206, a ROM 208, an ASIC (Application Specific Integrated Circuit) 210, a scanner motor 222, a main motor 224, a sheet feed solenoid 228, a sheet sensor 234, a cover opening switch 236, a light emitter 242, a light receiver 244, an input panel 252, a display panel 254, a charger 100, a new/old detecting sensor 115, etc.

Among these components, only the RAM 203, the NVRAM 206 (Non-Volatile RAM), the ROM 208, and the ASIC 210 are connected to the CPU 202. The CPU 202 controls each of the components via the ASIC 210 while storing a processed result in the RAM 204 or the NVRAM 206, according to a processing procedure stored in the ROM 208 or the NVRAM 206.

Further, the scanner motor 222 rotates the polygon mirror 23 or the like in the scanner unit 20.

Further, the main motor 24 rotates the photosensitive drum 99, the transfer roller 101, etc. while synchronizing them. The main motor 224 also rotates the input gear 65 which constitutes the gear mechanism portion 63 of the process cartridge 34. By this construction, the gear mechanism portion 63 is driven, so that the developing roller 38 and the agitator 36 in the process cartridge 34 can be rotated.

The cover opening switch 236 is disposed in the main frame 2 in such a positional relation that the switch is turned off when the opening 31 is covered by the front cover 32, and is turned on when the opening 31 is open (not shown). According to the turning on or off, the cover opening switch 236 detects whether the opening 31 is open or covered by the front cover 32.

The sheet feed solenoid 228 is used for feeding sheets.

The sheet sensor 234 is provided on the sheet conveying path, and detects that sheets are conveyed to the position of the transfer roller 101, and that sheets are separated from the position of the transfer roller 101.

The light emitter 242 operates upon receiving commands from the ASIC 210, and emits the light for detecting the residual amount of toner to the inside of the process unit 21 (inside of the toner containing chamber 40), via the residual toner amount detecting window 56 and the light transmission portion 57. At this moment, when the residual amount of toner filled in the process unit 21 is small, a light path in which, for example, the residual amount detecting light emitted from the light emitter 242 reaches the light receiver 244 is formed. Further, the light receiver 244 outputs detecting signals to the ASIC 210 only while the residual amount detecting light which has passed through the light path is received.

[Replacement State Setting Processing]

Hereinafter, a processing procedure for replacement state setting processing, which is executed by the CPU 202, will be described with reference to FIG. 8. The replacement state setting processing starts when power is supplied to the laser printer 1, or when the cover opening switch 236 detects the opening and closing (covering operation after opening) of the opening 31 operated by the front cover 32.

First, the rotation of the main motor 224 is started (S110). Here, the main motor 224 is rotated, thereby starting idling operation in which the agitator 36 is rotatingly driven.

Next, the new/old detecting sensor 115 of the new/old discriminating portion 112 checks whether or not the process cartridge 34 is replaced with a new process cartridge 34 (S120). Here, the new/old detecting sensor 115 of the new/old discriminating portion 112 detects that the process cartridge 34 is replaced with a new process cartridge 34.

In the processing in S120, if the new/old detecting sensor detects that the old process cartridge 34 has not been replaced with a new process cartridge 34 (S120: NO), the replacement state setting processing is terminated.

In the meantime, in the processing in S120, if the new/old detecting sensor detects that the old process cartridge 34 has been replaced with a new process cartridge 34 (S120: YES), the number of times of detection that the new/old detecting sensor detects that the old process cartridge 34 has been replaced with a new process cartridge 34 is accumulated (S130). In the embodiment, a new article detecting counter for accumulating the number of times of detection that the new/old detecting sensor detects that the old process cartridge 34 has been replaced with a new process cartridge 34 is stored in the NVRAM 206. Thus, in the processing in S130, the number of times of detection is accumulated by incrementing the new article detecting counter (adding 1), and thereby an accumulated value of the number of times of detection is stored in the NVRAM 206.

Next, it is checked whether the accumulated value (accumulated value of the new article detecting counter) of the number of times of detection that the new/old detecting sensor detects that the old process cartridge 34 has been replaced with a new process cartridge 34 is at a first predetermined detection threshold value (S140). In this step, it is checked whether or not the value accumulated by the new article detecting counter becomes the first detection threshold value set to a variable N1 stored in the NVRAM 206.

The process cartridge 34 used in the laser printer 1, depending on the amount of toner filled in the process cartridge includes two types of process cartridges, i.e., a first process cartridge to be mounted in the laser printer 1 when shipping, and a second process cartridge, that is, a marketed commodity to be is mounted in the laser printer 1 to replace the first process cartridge (replace the first process cartridge after shipping). Since the amount of toner filled in such different types of process cartridges is different from each other, it is necessary to vary a reference for detecting that that the process cartridge is in a replacement state where it needs to be replaced with a new one, according to the types of process cartridges, in the processing which will be described bellow. Here, as described above, the first process cartridge is mounted in the laser printer when only shipped, and a new first process cartridge would not be mounted again in the laser printer after shipping. For this reason, in the embodiment, the number of times of detection is checked such that a maximum number of times of replacement (a maximum count value to be accumulated by the new article detecting counter: '1' in the embodiment), that an old first process cartridge is replaced with a new process cartridge by a check-up and test, is set to the first detection threshold value so as to check the number of times of detection. Therefore, in the processing in S140, when the number of times of detection becomes the first detection threshold value, it is detected that the process cartridge is replaced with the first process cartridge. Further, when the number of times of detection is greater than the first detection threshold value, it is detected that the process cartridge is replaced with the second process cartridge. In the embodiment, the first process cartridge has a smaller amount of toner filled in the process cartridge than the second process cartridge.

In the processing in S140, when the number of times of detection becomes the first detection threshold value (S140: YES), it is determined that the process cartridge 34 is replaced with the first process cartridge, so that a reference for detecting in the processing which will be described below that the state of the process cartridge becomes the replacement state is set to a reference for the first process cartridge (S150). In the embodiment, in order to detect a state in which the toner filled in the process cartridge 34 has deteriorated as the replacement state, the number of times of agitation that toner is agitated by rotating the agitator 36 in the process cartridge 34 becomes a reference.

In a case where toner is agitated by the agitator 36, the smaller the amount of toner filled in the process cartridge (or the residual amount) is, the higher the probability that toner particles are agitated with the rotation of the agitator 36. Thus, the toner is apt to deteriorate. Therefore, in the processing in S150, a predetermined number of times of agitation (20,000 times in the embodiment) is set to a variable M stored in the NVRAM 206 as the reference for the first process cartridge, thereby setting the reference for the first process cartridge. In addition, the number of times of agitation is accumulated (by the CPU 202) in an agitation counter stored in the NVRAM 206 whenever agitation is performed by the agitator 36. However, in the embodiment, accumulation is performed according to the rotation of the main motor 224 which indirectly rotates the agitator 36, other than the number of times of agitation which is performed by the agitator 36.

In the meantime, in the above-described processing in S140, if the number of times of detection is not the first detection threshold value (S140: NO), it is determined that the process cartridge 34 is replaced with the second process cartridge, so that a reference for detecting that the state of the process cartridge 34 becomes the replacement state is set to a reference for the second process cartridge in the processing which will be described below (S160). Here, for the same reason as the processing in S150, a predetermined number of times of agitation (more than that of the first process cartridge: 40,000 times in the embodiment) is set to the variable M stored in the NVRAM 206 as the reference for the second process cartridge, thereby setting the reference for the second process cartridge.

In the processing in S150 and S160, if a reference for detecting that the state of the process cartridge 34 becomes the replacement state is set, the rotation of the main motor 224 which has been started in the processing in S100 is stopped (S170), and then the replacement state setting processing is terminated. In the processing in S170, the rotation of the main motor 224 is stopped, thereby completing the idling operation that the agitator 36 is rotatingly operated.

[Replacement State Detecting Processing]

Hereinafter, the processing procedure of replacement state detecting processing, which is executed by the CPU 202, will be described with reference to FIG. 9. The replacement state detecting processing is repeatedly performed during every predetermined period of time (5 ms in the embodiment).

First, the CPU checks whether the process cartridge 34 is in a replacement state where the process cartridge needs to be replaced, that is, whether or not the residual amount of toner filled in the process cartridge 34 is small (whether toner is empty), based on detecting signals from the light receiver 224 (S210). Here, if the detecting signals are output from the light receiver 244, the CPU determines that toner is empty.

In the processing in S210, if the CPU determines that toner is empty (S210: YES), it checks whether or not printing (namely, image forming operation) is being performed by each component connected to the ASIC 210 (S220).

If the CPU determines that the printing is being performed in the processing in S220 (S220: YES), a stop request for stopping the printing that is being performed is transmitted to the ASIC 210 (S230), and then the CPU proceeds to the next processing (the processing in S240). In addition, if the CPU determines that the printing is not being performed in the processing in S220 (S220: NO), the stop request is not transmitted to the ASIC 210, and then the CPU proceeds to the next processing (the processing in S240). In addition, the ASIC 210, which has received the stop request transmitted in the processing in S230, allows each component to perform operations until a sheet on printing is ejected, and then stops the operation of each component.

Then, a message (toner life end display) indicating that the process cartridge 34 should be replaced due to the decrease in the residual amount of toner is displayed on the display panel 254 (S240), and then the replacement state detecting processing is terminated.

In the above-described processing in S210, if the CPU determines that toner is not empty (S210: NO), it checks whether or not the process cartridge 34 is in a replacement state where the process cartridge needs to be replaced, more specifically, whether or not an accumulated value (accumulated value of the agitation counter) of the number of times of agitation of toner filled in the process cartridge 34 reaches a reference value (the value of the variable M) which requires replacement, based on the agitation counter and the variable M stored in NVRAM 206.

In the processing in S250, if the accumulated value by the agitation counter has reached the value of the variable M (S250: YES), the CPU proceeds to the processing in S220 to check whether or not printing is performed. On the other hand, if the accumulated value by the agitation counter has not yet reached the value of the variable M (S250: NO), the replacement state detecting processing is terminated.

[Effect of First Embodiment]

Figure 8:
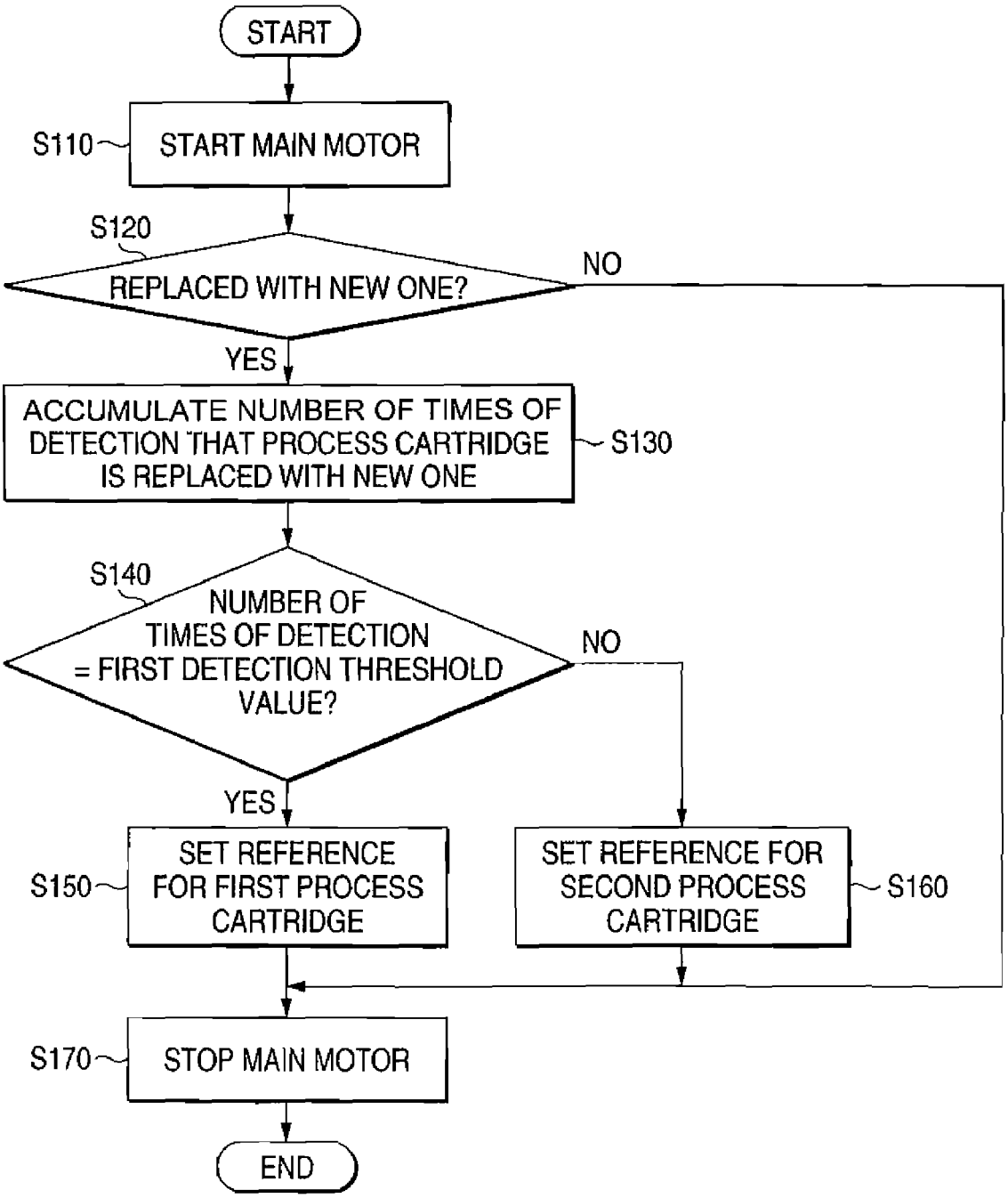
FIG. 8 is a flow chart showing a processing procedure for replacement state setting processing according to first and second embodiments.

According to the laser printer 1 constructed as above, in the processing in S140 shown in FIG. 8, by comparing the number of times of mounting of new process cartridges (the accumulated value of the new article detecting counter) with a maximum number of times of replacement that an old first process cartridge is replaced with a new process cartridge until shipping, the CPU can determine whether the type of a process cartridge after replacement is the first process cartridge mounted in the laser printer 1 when shipping or the second process cartridge which is replaced after shipment.

Figure 9:
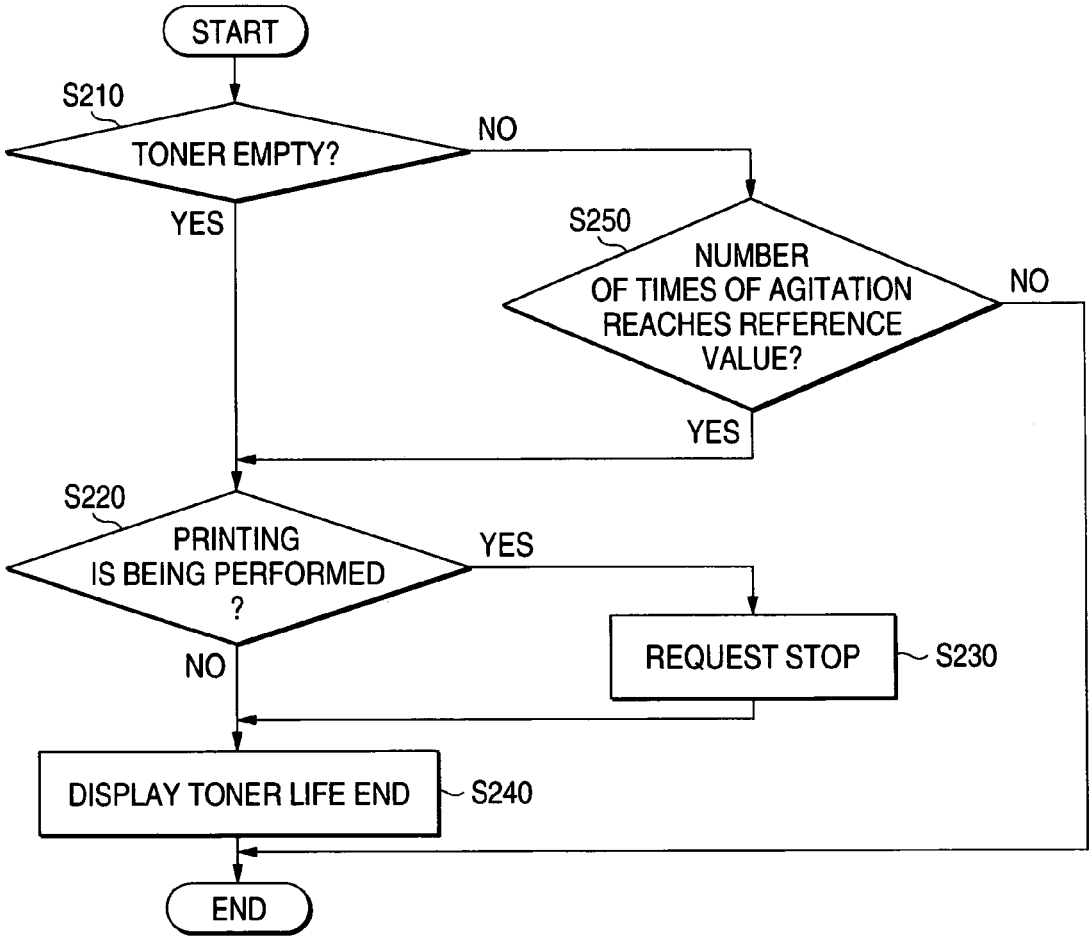
FIG. 9 is a flow chart showing a processing procedure for replacement state detecting processing according to the first and second embodiments and a third embodiment.

In the processing in S210 and S250 shown in FIG. 9, if the CPU determines that the process cartridge 34 is in a state where the process cartridge needs to be replaced, the printing that is being performed can be stopped in the processing in S230, and a message indicating that the process cartridge 34 should be replaced can be sent.

At this moment, the reference value (number of times of agitation that has been set) for determination in the processing in S250 shown in FIG. 9 is set to the value corresponding to the type of the process cartridge 34 which is determined in the processing in S140 shown in FIG. 8. Accordingly, the CPU can determine whether or not the reference value reaches 'the number of times of agitation that has been set' corresponding to the type of the process cartridge 34. Thus, it can be prevented that the printing is stopped and the message for replacement is sent, in spite of non-deterioration of toner. Further, it can be prevented that the printing is not stopped and the message replacement is not sent, in spite of deterioration of toner. As a result, the printing can be properly stopped in the processing in S230 shown in FIG. 9, and the message for replacement can be properly sent in the processing in S240 shown in FIG. 9.

Second Embodiment

The laser printer 1 according to a second embodiment is different from the laser printer 1 according to the first embodiment in that the laser printer 1 of the second embodiment does not include the configuration in which the light emitter 242 and the light receiver 244 detects that toner is empty.

Instead of including the configuration in which the light emitter 242 and the light receiver 244 detects that toner is empty, whenever image data indicating an image to be printed is generated, the CPU 202 accumulates the number of dots required in forming the image indicated by the image data when the image is printed, in a dot counter stored in the NVRAM 206. As described below, by comparing an accumulated value of the dot counter with the value obtained by converting the amount of toner filled in the process cartridge 34 corresponding to the type thereof into the number of dots, the CPU determines whether or not toner is empty.

[Replacement State Setting Processing]

In the replacement state setting processing according to the second embodiment, the reference value set in the processing in S150 and S160 is different from that of the first embodiment.

In the processing in S150 and S160 according to the embodiment, the aforementioned number of times of agitation and a total number of dots which form an image printed by the laser printer 1 are set. The total number of dots shows that the larger the value thereof is, the more the amount of toner to be actually used in forming an image is. Thus, if the process cartridge has a large amount of toner therein, the process cartridge will not become the replacement state where the process cartridge needs to be replaced until the period of time corresponding to the amount of toner filled in the process cartridge has lapsed.

Therefore, in the processing in S150 and S160, a value obtained by converting the amount (or the amount from which an amount required in printing a predetermined image is subtracted) of toner filled in the process cartridge into the number of dots, according to each amount of toner filled in the process cartridge, is set to a variable D stored in the NVRAM 206, thereby setting the reference for each process cartridge. In the embodiment, a specific reference value for the first process cartridge is set to 20 billions, and a specific reference value for the second process cartridge is set to 40 billions.

In addition, in the processing in S150 and S160, the reference is set and the dot counter is reset (to '0')

[Replacement State Detecting Processing]

In the replacement state detecting processing according to the embodiment, a method of detecting whether or not toner is empty is different from that of the first embodiment.

To be more specific, in the processing in S210 according to the embodiment, the CPU checks whether or not the process cartridge 34 is in a replacement state where the process cartridge needs to be replaced, more specifically, whether the total number (the accumulated value of the toner counter) of dots used in forming an image reaches the reference value (value of the variable D) for determining that toner is empty. In the embodiment, since the number of dots required in forming an image is accumulated by the dot counter, if the accumulated value is above the reference value set to the variable D for determining that toner is empty, the CPU determines that toner is empty.

[Effect of Second Embodiment]

According to the laser printer 1 constructed as above, an operation and effect to be described below can be obtained, besides the operation and effect obtained by the same construction as the first embodiment.

According to the laser printer 1, in the processing in S210 shown in FIG. 9, the state in which the total number (the accumulated value of the dot counter) of dots used in forming an image reaches the reference value for determining that toner is empty, can be detected as the replacement state where the process cartridge needs to be replaced.

At this time, the reference value (the total number of dots) for determination in the processing in S210 is set to the value corresponding to the type of the process cartridge 34 which is determined in the processing in S140 shown in FIG. 8. Accordingly, the CPU can determine whether or not the reference value reaches 'the total number of dots' corresponding to the type of the process cartridge 34. Thus, it can be prevented that the printing is stopped and the message for replacement is sent, in spite that the residual amount of toner is enough. Further, it can be prevented that the printing is not stopped and the message replacement is not sent, in spite that there is no residual amount of toner.

Further, in the processing in S210 shown in FIG. 9, since the accumulated value of the dot counter is used in detecting that toner is empty, a false detection caused when the toner inside the process cartridge 34 physically blocks the light path from the light emitter 242 to the light receiver 244, will not occur, unlike the construction composed of the light emitter 242 and the light receiver 244.

Third Embodiment

A laser printer according to a third embodiment is constructed similar to the laser printer 1 according to the second embodiment. Since the third embodiment and the first embodiment are different in only a part of the processing procedure, only the differences between the embodiments will be described in detail.

[Replacement State Setting Processing]

In the replacement state setting processing according to the third embodiment, the CPU checks whether or not an accumulated value (accumulated value of the new article detecting counter) of the number of times of detection that the new/old detecting sensor detects that an old process cartridge 34 has been replaced with a new process cartridge 34 is above a second predetermined detection threshold value (S132). Here, the CPU checks whether or not the accumulated value of the new article detecting counter is above the second predetermined detection threshold value (value larger than the first detection threshold value; '2' in the embodiment). In addition, the second detection threshold value is set to a variable N2 stored in the NVRAM 206.

In the processing in S132, if the accumulated value of the number of times of detection is not below the second detection threshold value (S132: NO), the CPU proceeds to the processing in S160. On the other hand, if the accumulated value of the number of times of detection is below the second detection threshold value (S132: YES), the CPU proceeds to the processing in S140.

If the CPU determines that the answer is 'NO' in the processing in S140, it checks whether or not the number of sheets that have been printed by the laser printer 1 is below a predetermined forming threshold value (S142). In the embodiment, whenever images are printed, the number of pages that have been printed is accumulated in a page counter stored in the NVRAM 206 (by the CPU 202). For this reason, in the processing in S142, the CPU checks whether or not the accumulated value is below the forming threshold value. In the embodiment, the maximum number ('10' in the embodiment) of pages which can be printed for a check-up, test and the like until shipping is set to a variable P stored in the NVRAM 206 as the aforementioned forming threshold value. Based on the value of the variable P, the number of pages which have been printed is checked.

In the processing in S142, if the number of pages that have been printed is below the forming threshold value (S142: YES), the CPU proceeds to the processing in S150. On the other hand, if the number of pages that have been printed is not below the forming threshold value (S142: NO), the CPU proceeds to the processing in S160. Accordingly, if the number of pages that have been printed is below the forming threshold value even though the number of times of detection reaches the first detection threshold value, the CPU determines that the process cartridge is replaced with the first process cartridge.

In addition, in the subsequent processing in S150 and S160, a reference is set and the dot counter is reset (to '0').

[Effect of Third Embodiment]

According to the laser printer 1 constructed as above, an operation and effect to be described below can be obtained, besides the operation and effect obtained by the same construction as the second embodiment.

According to the laser printer 1, by the process S132 to S142, the CPU determines whether the type of a process cartridge after replacement is the first process cartridge mounted in the laser printer 1 when shipping or the second process cartridge mounted in the laser printer 1 after shipping, not only based on the number of times of mounting of new process cartridges (accumulated value of the new article detecting counter), but also based on the maximum number (accumulated value of the page counter) of pages which can be printed until shipping.

It is preferable to have a configuration in which the type of a process cartridge is determined by a plurality of parameters, in order to improve accuracy of determining the type of a process cartridge.

MODIFIED EXAMPLE

Although the preferred embodiments of the invention have been described above, the present invention is not limited to the above-described embodiments, but various forms can be obtained so long as they belong to the technical scope of the present invention.

For example, the construction in which whether or not the process cartridge 34 is new is determined by the new/old discriminating portion 112 was exemplified in the embodiment. However, other things than the new/old discriminating portion 112 can be adopted as a construction for such a determination. For example, a construction which realizes the same effect by using a software method can be adopted.

The construction in which the amount of consumed toner is accumulated by accumulating the number of dots in the dot counter is exemplified in the second and third embodiments. However, other construction for accumulating the amount of consumed toner may be adopted. For example, a construction in which the area of dots required in forming an image is accumulated may be adopted.

The construction in which the number of times of agitation corresponding to the type of the process cartridge 34 is set for the reference in the processing in S150 and S160 shown in FIG. 8 is exemplified in the first embodiment. However, 'the total number of dots' alone, which is used in the second embodiment, may be set for the reference.

Figure 11:
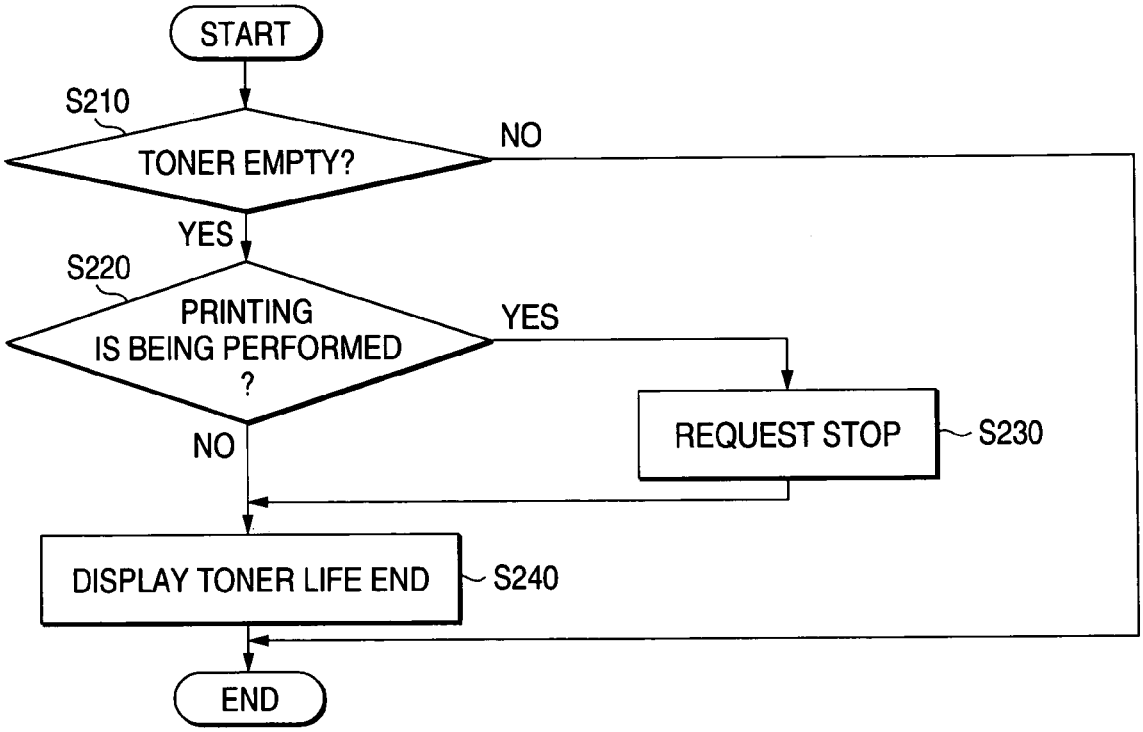
FIG. 11 is a flow chart showing a processing procedure for replacement state detecting processing according to an additional embodiment.

The construction in which it is determined whether the number of times of agitation reaches a reference value in the processing in S250 shown in FIG. 9 is exemplified in the above embodiments. However, as shown in FIG. 11, if it is determined '0' in the processing in S210 without performing processing in S210, the replacement state detecting processing may be immediately terminated.

Figure 10:
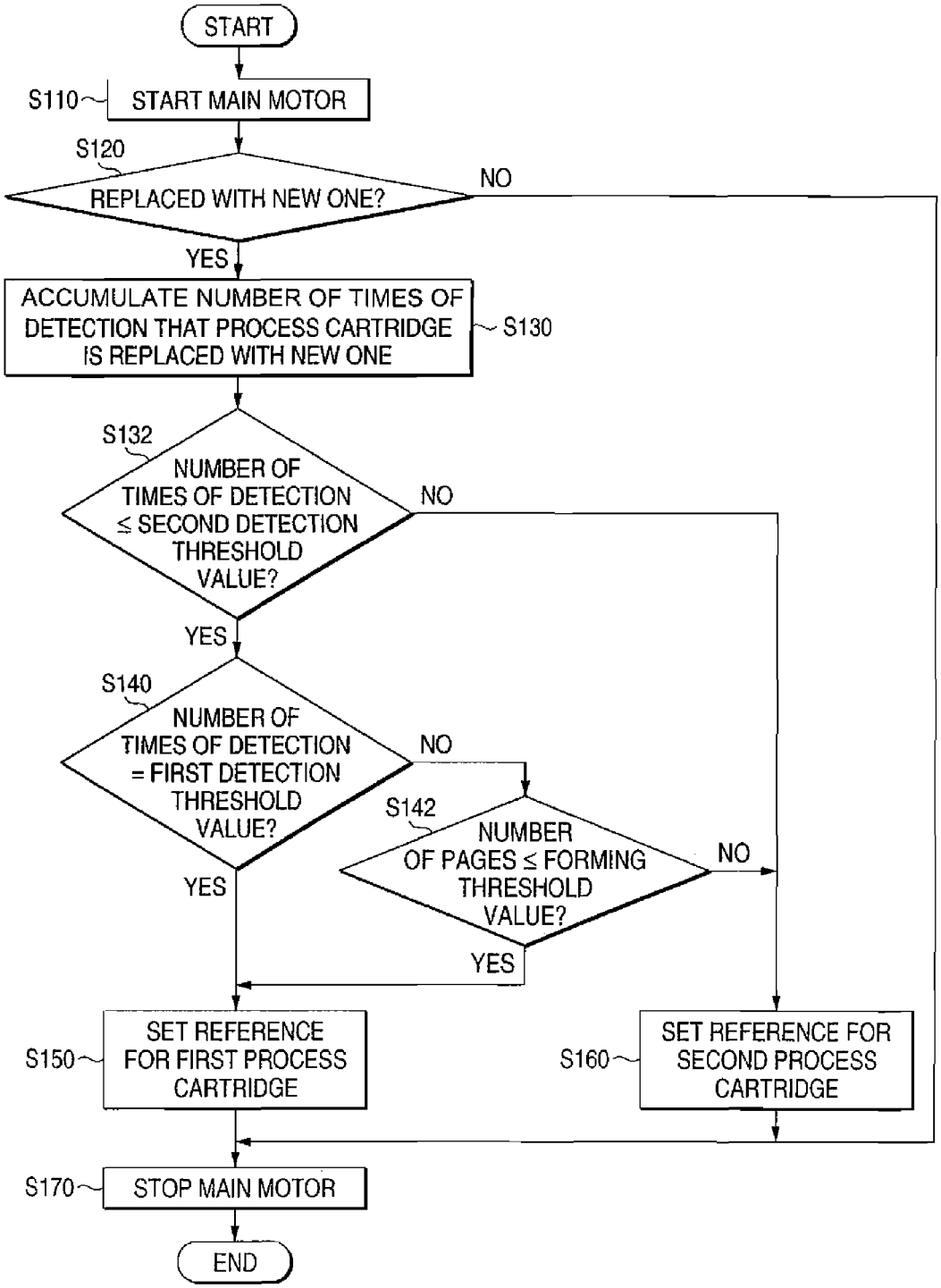
FIG. 10 is a flow chart showing a processing procedure for replacement state setting processing according to the third embodiment.
Figure 12:
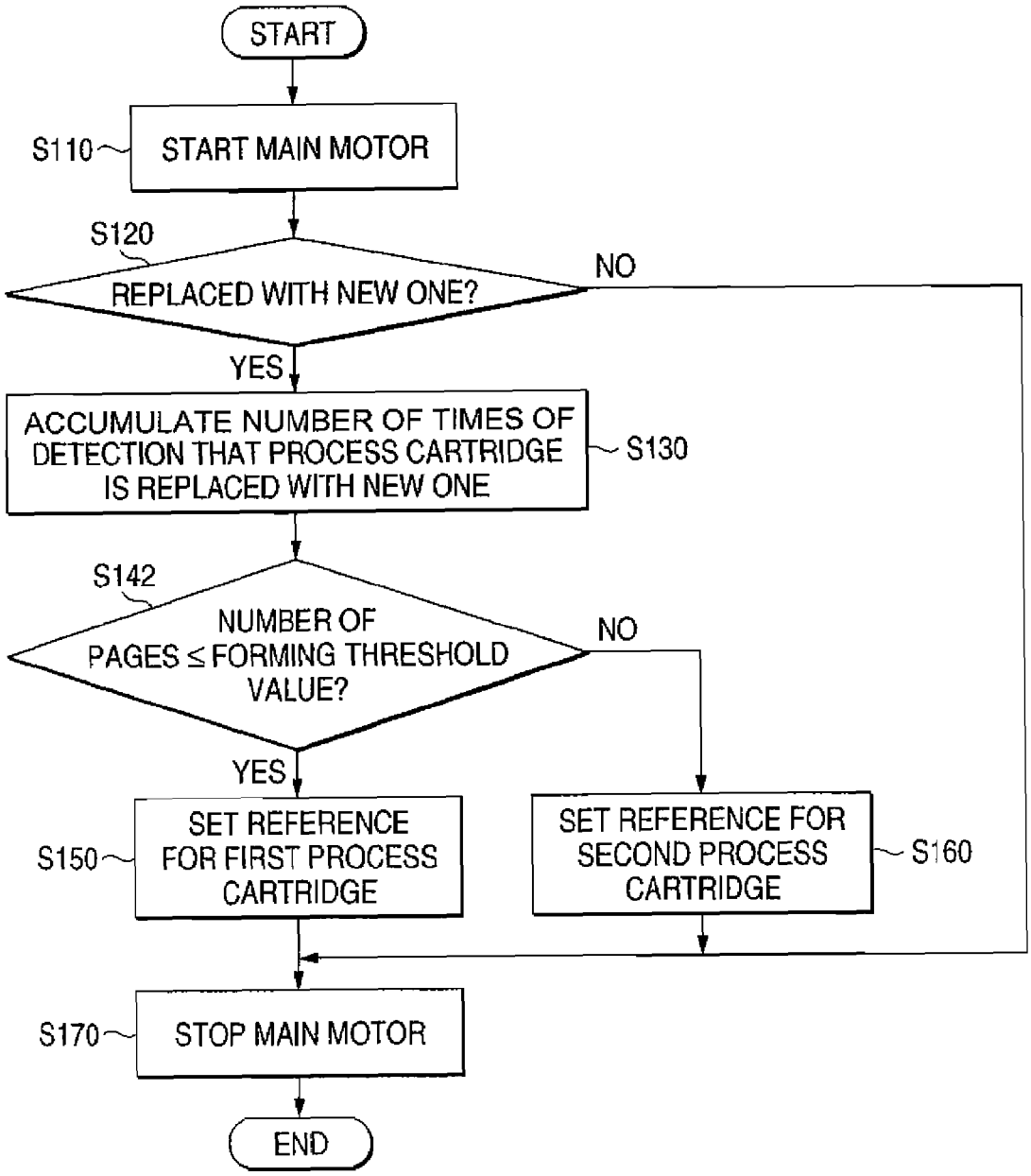
FIG. 12 is a flow chart showing a processing procedure for replacement state setting processing according to an additional embodiment.

In the third embodiment, the construction in which it is determined that the type of a process cartridge is determined by processing in S132 to S142 shown in FIG. 10 is exemplified. However, the type of the process cartridge 34 may be determined by only the processing in S142 among these kinds of processing. In this case, as shown in FIG. 12, after the processing in S130, the present invention may be constructed in the following manner. Specifically, the CPU proceeds to the processing in S142. In the processing in S142, if the CPU determines that the answer is 'YES', it proceeds to the processing in S150. On the other hand, if the CPU determines that the answer is 'NO' in the processing in S142, it proceeds to the processing in S160. If the present invention is constructed in this way, the CPU determines whether the type of a process cartridge after replacement is the first process cartridge mounted in the laser printer 1 when shipping or the second process cartridge mounted in the laser printer 1 after shipping, based on the maximum number (accumulated value of the page counter) of pages which can be printed until shipping.

In the embodiments described above, the laser printer 1 functions as the image forming apparatus of the invention.

The new/old discriminating portion 112 and the processing in S120 shown in FIGS. 8, 10 and 12 function as anew/old detecting unit. The processing in S130 in the same drawings functions as a detection storage unit, and the processing in S150 and S160 function as a replacement setting unit.

The processing in S140 shown in FIG. 8, the processing in S132 to S142 shown in FIG. 10, and the processing in S142 shown in FIG. 12 function as a type determining unit. The page counter and the CPU 202 which accumulates the number of pages in the page counter function as a forming storage unit. The dot counter and the CPU 202 which accumulates the number of dots in the dot counter function as a consumption amount storage unit. The agitation counter and the CPU 202 which accumulates the number of times of agitation in the agitation counter function as an agitation storage unit.

The processing in S210 and S250 (S210 alone in FIG. 11) shown in FIGS. 9 and 11 function as a replacement detecting unit. The processing in S240 shown in the same drawings functions as a replacement notifying unit. The processing in S230 shown in the same drawings functions as an operation stopping unit.

Incidentally, the process unit 21 can be constructed as a process cartridge.

It is to be understood that the invention is not limited to the specific embodiment described above and that the invention can be embodied with the components modified without departing from the spirit and scope of the invention. The invention can be embodied in various forms according to appropriate combinations of the components disclosed in the embodiment described above. For example, some components may be deleted from all components shown in the embodiment. Further, the components in different embodiments may be used appropriately in combination.

In addition, a program for attaining the functions in the embodiments may be recorded in a computer-readable recording medium. In this case, the program recorded in the recording medium is read and executed by a computer system. Incidentally, the "computer system" mentioned here includes an operation system or hardware such as peripheral equipment.

In addition, the "computer system" includes a homepage providing environment (or display environment) when it uses a WWW system.

On the other hand, the "computer-readable recording medium" means a portable medium such as a flexible disk, a magneto-optical disk, a ROM or a CD-ROM, or a storage unit such as a hard disk included in the computer system. Further the "computer-readable recording medium" includes a medium for holding the program for a predetermined time, such as a volatile memory (RAM) in a computer system as a server or a client when the program is transmitted through a network such as the Internet or a communication circuit such as a telephone circuit.

In addition, the program may be transmitted from a computer system storing the program in a storage unit or the like to another computer system through a transmission medium or by a transmitted wave in the transmission medium. Here, the "transmission medium" for transmitting the program means a medium having a function of transmitting information, including a network (communication circuit) such as the Internet or a communication circuit (communication line) such as a phone line.

In addition, the program may be prepared for attaining a part of the aforementioned functions. Further, the program may be a so-called difference file (difference program) which can attain the aforementioned functions in combination with a program which has been already recorded in the computer system.

Further, these modifications may be used selectively and suitably in combination.

What is claimed is:

1. An image forming apparatus used with a replaceable process cartridge mounted therein, comprising:

a new article detecting unit which detects if the mounted process cartridge is a new process cartridge;

a detection storage unit which stores a number of times of detection that the new article detecting unit has detected that the mounted process cartridge is a new process cartridge; and a type determining unit which determines a type of the mounted process cartridge, based on the number of times of detection stored in the detection storage unit, when the new article detecting unit has detected that the mounted process cartridge is a new process cartridge.

2. The image forming apparatus according to claim 1, wherein the detection storage unit stores a number of times of detection obtained by accumulating the detection that the new article detecting unit has detected that the mounted process cartridge is a new process cartridge.

3. The image forming apparatus according to claim 1, wherein the type determining unit determines the type of the process cartridge by comparing the number of times of detection stored in the detection storage unit with a predetermined detection threshold value.

4. The image forming apparatus according to claim 3, wherein in state where the detection threshold value is a maximum number of times of detection that can be stored in the detection storage unit until shipping the image forming apparatus, the type determining unit determines that the mounted process cartridge is a first process cartridge which is mounted in the image forming apparatus at the time of shipping when the number of times of detection stored in the detection storage unit is below the detection threshold value, and the type determining unit determines that the mounted process cartridge is a second process cartridge which is mounted in the image forming apparatus to replace the first process cartridge after shipping when the number of times of detection stored in the detection storage unit is above the detection threshold value.

5. The image forming apparatus according to claim 4, further comprising:

a forming storage unit which stores a number of times of image forming which is performed by the image forming apparatus;

wherein in case where the number of times of detection stored in the detection storage unit is below the detection threshold value, the type determining unit determines that the mounted process cartridge is the second process cartridge when the number of times of image forming stored in the forming storage unit is above a predetermined forming threshold value, and the type determining unit determines that the mounted process cartridge is the first process cartridge when the number of times of image forming stored in the forming storage unit is below the predetermined forming threshold value.

6. The image forming apparatus according to claim 1, further comprising:

a forming storage unit which stores a number of times of image forming which is performed by the image forming apparatus;

wherein the type determining unit determines the type of the mounted process cartridge, based on the number of times of detection stored in the detection storage unit and the number of image forming times stored in the forming storage unit.

7. The image forming apparatus according to claim 6, wherein the forming storage unit stores the number of times of image forming obtained by accumulating the fact that image forming is performed.

8. The image forming apparatus according to claim 1, further comprising:

a replacement setting unit which sets a replacement state of the process cartridge corresponding to the type of the process cartridge which is determined by the type determining unit;

a replacement detecting unit which detects that a state of the mounted process cartridge becomes the replacement state set by the replacement setting unit; and a replacement notifying unit which notifies a message indicating that the process cartridge should be replaced after the replacement detecting unit has detected that the state of the process cartridge becomes the replacement state.

9. The image forming apparatus according to claim 8, further comprising:

a consumption amount storage unit which stores the amount of toner consumed in forming an image in the process cartridge after the process cartridge is replaced with a new process cartridge;

wherein the replacement setting unit sets an amount of toner filled in the process cartridge corresponding to the type of the process cartridge which is determined by the type determining unit; and the replacement detecting unit detects that the amount of consumed toner stored in the consumption amount storage unit reaches the amount of toner filled in the process cartridge set by the replacement setting unit.

10. The image forming apparatus according to claim 1, further comprising:

a replacement setting unit which sets a replacement state of the process cartridge corresponding to the type of the process cartridge which is determined by the type determining unit;

a replacement detecting unit which detects that a state of the mounted process cartridge becomes the replacement state set by the replacement setting unit; and an operation stopping unit which stops image forming operation performed by the image forming apparatus after the replacement detecting unit has detected that the state of the process cartridge becomes the replacement state.

11. The image forming apparatus according to claim 10, further comprising:

a consumption amount storage unit which stores the amount of toner consumed in forming an image in the process cartridge after the process cartridge is replaced with a new process cartridge;

wherein the replacement setting unit sets an amount of toner filled in the process cartridge corresponding to the type of the process cartridge which is determined by the type determining unit; and the replacement detecting unit detects that the amount of consumed toner stored in the consumption amount storage unit reaches the amount of toner filled in the process cartridge set by the replacement setting unit.

12. An image forming apparatus used with a replaceable process cartridge mounted therein, comprising:

a new article detecting unit which detects if the mounted process cartridge is a new process cartridge;

a forming storage unit which stores a number of times of image forming which is performed by the image forming apparatus; and a type determining unit which determines the type of the mounted process cartridge based on the number of image forming times stored in the forming storage unit when the new article detecting unit has detected that the mounted process cartridge is a new process cartridge.

13. The image forming apparatus according to claim 12, further comprising:

an agitation storage unit which stores the number of times of agitation of an agitating member which agitates toner in the process cartridge, after the process cartridge is replaced with a new process cartridge;

a replacement setting unit setting a predetermined number of times of agitation of the agitating member corresponding to the type of the process cartridge which is determined by the type determining unit; and a replacement detecting unit detecting that the number of times of agitation stored in the agitation storage unit reaches the number of times of agitation which is set by the replacement setting unit.

14. The image forming apparatus according to claim 13, wherein the agitation storage unit stores a number of times of agitation obtained by accumulating the agitation of the toner inside the process cartridge.

15. A computer readable medium storing information for causing a computer system of an image forming apparatus, used with a replaceable process cartridge mounted therein, to perform a process comprising:

detecting if the mounted process cartridge is a new process cartridge;

storing a number of times of detection in which it is detected that the mounted process cartridge is a new process cartridge; and determining a type of the mounted process cartridge, based on the stored number of times of detection, when it is detected that the mounted process cartridge is a new process cartridge.

* * * * *